US009442425B2

(12) United States Patent
Matsumoto

(10) Patent No.: US 9,442,425 B2
(45) Date of Patent: Sep. 13, 2016

(54) DEVELOPING APPARATUS AND IMAGE FORMING APPARATUS

(71) Applicant: CANON KABUSHIKI KAISHA, Tokyo (JP)

(72) Inventor: Atsushi Matsumoto, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/714,532

(22) Filed: May 18, 2015

(65) Prior Publication Data

US 2015/0338777 A1 Nov. 26, 2015

(30) Foreign Application Priority Data

May 23, 2014 (JP) ..... 2014-107192

(51) Int. Cl.
*G03G 15/08* (2006.01)

(52) U.S. Cl.
CPC ..... *G03G 15/0891* (2013.01); *G03G 15/0893* (2013.01); *G03G 2215/0833* (2013.01)

(58) Field of Classification Search
USPC ..... 399/254, 256
See application file for complete search history.

(56) References Cited

U.S. PATENT DOCUMENTS

2012/0269555 A1 10/2012 Matsumoto et al.
2015/0010335 A1 1/2015 Akita et al.
2015/0071683 A1 3/2015 Takahashi et al.

FOREIGN PATENT DOCUMENTS

JP S59-100471 A 6/1984
JP H02-21591 B2 5/1990
JP 2000-112238 A 4/2000
JP 2012-234153 A 11/2012

OTHER PUBLICATIONS

Atsushi Matsumoto, U.S. Appl. No. 14/718,197, filed May 21, 2015.

*Primary Examiner* — Minh Phan
(74) *Attorney, Agent, or Firm* — Fitzpatrick, Cella, Harper & Scinto

(57) ABSTRACT

A developing apparatus includes a developer bearing member which bears a developer, a developing container that includes a developer circulation path, a conveying member which is rotatably installed in the circulation path, and an outlet which is formed on a side surface of the circulation path facing the conveying member to discharge the developer. The conveying member includes a rotating shaft and a helical blade portion which is formed around the rotating shaft. The conveying member has a first region including a region facing the outlet and a second region adjacent to the first region at an upstream in a conveying direction of the conveying member. The helical blade portion is not formed in the first region, a protruding portion protruding from the rotating shaft is formed in at least a part of the first region, and the helical blade portion is formed in the second region.

4 Claims, 22 Drawing Sheets

DEVELOPING APPARATUS AND IMAGE FORMING APPARATUS

BACKGROUND OF THE INVENTION

1. Field of the Invention

The present invention relates to an image forming apparatus equipped with a developing apparatus that develops an electrostatic latent image formed on an image bearing member and forms a visible image through an electrophotographic system, an electrostatic recording system, or the like.

2. Description of the Related Art

An image forming apparatus that develops an electrostatic latent image formed on an image bearing member as a toner image through a developing apparatus using a developer including a toner and a carrier configured with a magnetic particle, transfers the toner image onto a recording material, and then fixes the toner image onto the recording material through heating and pressing has been widely used.

The developing apparatus frictionally charges the toner and the carrier by conveying the developer while rotating a screw member to agitate the developer in a circulation path in a developing container. In the developer including the toner and the carrier, as the carrier that is not consumed by image forming continuously circulates while being subjected to friction in the developing container, charging performance of the carrier is gradually lowered. For this reason, in a technique disclosed in Japanese Patent Laid-Open No. S59-100471, a new carrier is supplied to the developing container, and part of the developer conveyed through an outlet formed in a circulation path is caused to overflow and be discharged. As a result, an average charging performance of the carrier of the developer is secured.

Further, a developing apparatus configured such that force acting on a developer in a circumferential direction or an outward diameter direction by rotation of a screw member in a region facing a developer outlet is smaller than other regions has been proposed in Japanese Patent Laid-Open No. 2000-112238. As an embodiment, a configuration in which a blade of a screw member is downsized or omitted in a region facing a developer outlet is described. As a result, it is possible to suppress the developer from being churned up by the blade of the screw member in the developing container facing the developer outlet and discharge only the developer that is truly excessive.

Further, in a technique disclosed in U.S. Patent Application Publication No. 2012/269555 A1, a screw blade of a region facing a developer outlet is omitted, and a rib that agitates or vibrates a developer of a region along the developer outlet with rotation of the screw blade is locally formed in that region. The rib is smaller in diameter than the screw blade, and through this configuration, the developer of the region facing the developer outlet is vibrated. As a result, even in a configuration in which the screw blade of the region facing the developer outlet is omitted or the configuration of suppressing the developer from being churned up by the screw member as in Japanese Patent Laid-Open No. 2000-112238, the developer can be stably discharged by the vibration regardless of fluidity of the developer.

However, a small diameter screw blade or a small diameter rib for vibration is installed around a screw shaft in the portion facing the developer outlet. The developer is not churned up by the small diameter screw blade or the small diameter rib. However, the developer is hoisted by an end portion of the screw blade at the upstream side of the portion in which the screw blade of the region facing the developer outlet is omitted. The developer collides with the small diameter screw blade or the small diameter rib according to an installation phase of the small diameter screw blade or the small diameter rib. As a result, there is a problem in that the developer further is churned up and overflows from the developer outlet (see FIG. 5).

A phenomenon that the developer is churned up by the rib is suppressed by finding an appropriate size of the small diameter screw blade or the small diameter rib. However, the developer that is churned up by the end portion of the screw blade at the upstream side of the portion in which the screw blade is omitted is further churned up by the small diameter screw blade or the small diameter rib. As a result, the churned developer leaks. As described above, the developer that need not be originally discharged from the developer outlet is churned up by the small diameter screw blade or the small diameter rib and overflows. In this case, an amount of the developer in the developing container gradually decreases, and it is difficult to sufficiently coat the surface of the developing sleeve with the developer, and thus density irregularity is likely to occur.

The present invention was made to solve the above problems, and it is desirable to provide a developing apparatus capable of suppressing the developer from being churned up and discharged by a protruding portion arranged in the region facing the developer outlet.

SUMMARY OF THE INVENTION

In order to achieve the above objet, an exemplary configuration of a developing apparatus according to the present invention includes a developing apparatus, comprising: a developer bearing member which bears a developer including a toner and a magnetic carrier; a developing container that includes a circulation path in which the developer circulates and contains the developer to be supplied to the developer bearing member; a conveying member which is rotatably installed in the circulation path, and conveys the developer in the circulation path; and an outlet which is formed on a side surface of the circulation path facing the conveying member, and is able to discharge the developer; wherein the conveying member includes a rotating shaft which is rotatable and a helical blade portion which is formed around the rotating shaft, wherein the conveying member has a first region including a region facing the outlet and a second region adjacent to the first region at an upstream in a conveying direction of the conveying member, the helical blade portion is not formed in the first region, a protruding portion protruding from the rotating shaft is formed in at least a part of the first region, and the helical blade portion is formed in the second region, and wherein the protruding portion is formed at an inner side further than a maximum outer diameter of the helical blade portion of the conveying member, and the following formula is satisfied of $L1 \leq x \leq L2$, $(\gamma-1)\times 360\times(x/p)-\alpha(x)\neq 0$, where x is a distance in a shaft line direction of the rotating shaft based on an end point of the first region at an uppermost stream side in the conveying direction of the conveying member, L1 is a distance in the shaft line direction of the rotating shaft between the end point of the first region at the uppermost stream side in the conveying direction of the conveying member and an end point of the protruding portion at an upstream side in the conveying direction of the conveying member, L2 is a distance in the shaft line direction of the rotating shaft between the end point of the first region at the upstream side in the conveying direction of the conveying member and an end point of the protruding portion at a downstream side in the conveying direction of the conveying member, γ is a value obtained by dividing an angular speed of the developer conveyed by the blade portion around the rotating shaft of the conveying member at the end point of the second region at the downstream side by an angular speed of the conveying member, p is a pitch of the helical blade portion of the conveying member in the second region, and α(x) is an angle that is formed by a first straight line and a second straight line when the rotation direction of the conveying member is positive, the first straight line passing an apex of the blade portion at the end point of the second region at the downstream side and a rotational center of the rotating shaft of the conveying member, the second straight line passing through a point that is at a region protruding from the rotating shaft by 0.8×B or more on a developer conveying surface of the protruding portion in a cross section of a point of the distance x in the protruding portion and the rotational center of the rotating shaft, wherein B indicates a distance obtained by subtracting a shaft diameter from an apex of the protruding portion.

Further, features of the present invention will become apparent from the following description of exemplary embodiments with reference to the attached drawings.

DESCRIPTION OF THE EMBODIMENTS

Figure 1:
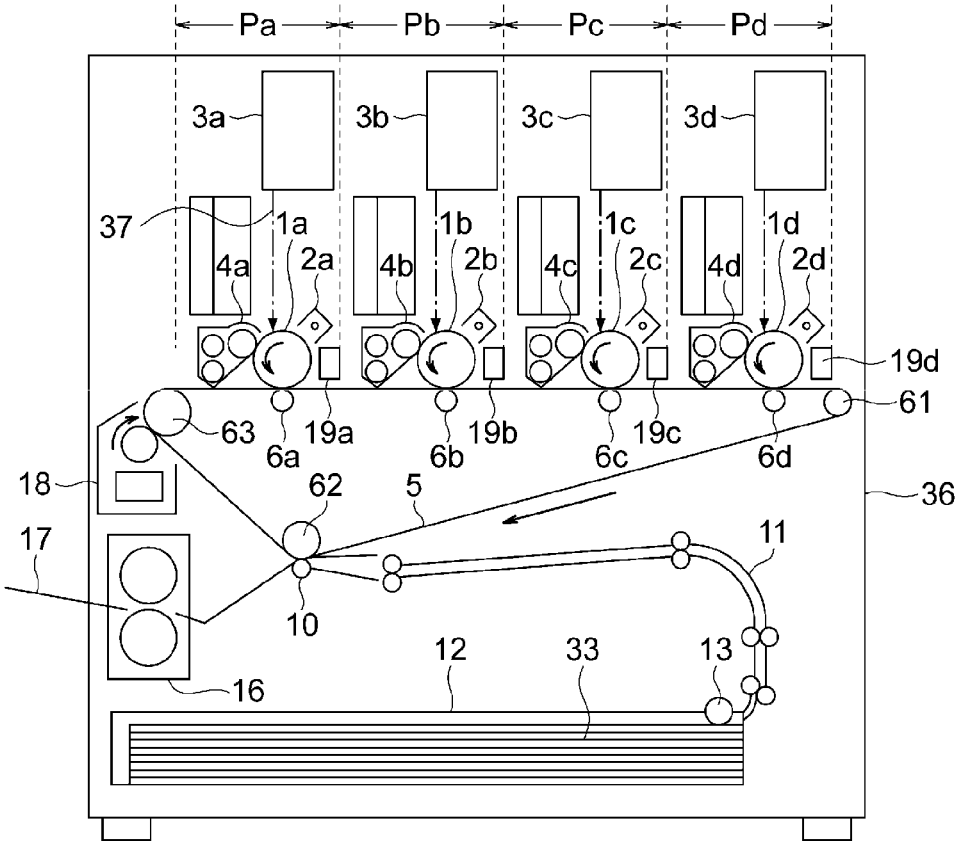
FIG. 1 is an explanatory cross-sectional view illustrating a configuration of an image forming apparatus equipped with a developing apparatus according to the present invention.

Hereinafter, an embodiment of an image forming apparatus equipped with a developing apparatus according to the present invention will be specifically described with reference to the appended drawings. FIG. 1 is an explanatory cross-sectional view illustrating a full-color image forming apparatus employing an electrophotographic system as an embodiment of an image forming apparatus equipped with a developing apparatus according to the present invention. Here, a copying machine, a printer, a recording image display device, a facsimile device, or the like may be applied as an image forming apparatus.

<Image Forming Apparatus>

Referring to FIG. 1, an image forming apparatus 36 according to the present embodiment includes four image forming portions Pa, Pb, Pc, and Pd of yellow, magenta, cyan, and black serving as an image forming portion. Here, for the sake of convenience of description, the image forming portions Pa, Pb, Pc, and Pd are also referred to representatively as an "image forming portion P." The same applies to other image forming processing portions. Each of the image forming portions P includes photosensitive drums 1*a*, 1*b*, 1*c*, and 1*d*, each of which serves as an image bearing member that bears an electrostatic latent image, and is configured with a drum-like electrophotographic photosensitive element that rotates in an arrow direction (a counterclockwise direction) of FIG. 1.

Charging apparatuses 2*a*, 2*b*, 2*c*, and 2*d* serving as a charging portion and laser beam scanners 3*a*, 3*b*, 3*c*, and 3*d* serving as an image exposing portion arranged above a photosensitive drum 1 in FIG. 1 are installed around the photosensitive drums 1. Further, developing apparatuses 4*a*, 4*b*, 4*c*, and 4*d* serving as a developing portion that supplies a developer to the electrostatic latent image borne on the surface of each of the photosensitive drums 1 and forms a toner image are installed. Furthermore, an image forming portion including primary transfer rollers 6*a*, 6*b*, 6*c*, and 6*d* serving as a primary transfer portion, cleaning apparatuses 19*a*, 19*b*, 19*c*, and 19*d* serving as a cleaning portion, and the like is installed.

The respective image forming portions P have the same configuration, and the photosensitive drums 1 arranged in the respective image forming portions P have the same configuration. Thus, the photosensitive drums 1*a*, 1*b*, 1*c*, and 1*d* are also referred to representatively as a "photosensitive drum 1." Similarly, the charging apparatuses 2, the laser beam scanners 3, the developing apparatuses 4, the primary transfer rollers 6, and the cleaning apparatuses 19 arranged in the respective image forming portions P have the same configuration in the respective image forming portions P. Thus, the description will proceed with the charging apparatus 2, the laser beam scanner 3, the developing apparatus 4, the primary transfer roller 6, and the cleaning apparatus 19.

<Image Forming Sequence>

Next, an image forming sequence of the image forming apparatus 36 will be described. First, the surface of the photosensitive drum 1 is uniformly charged by the charging apparatus 2. Then, the photosensitive drum 1 of which surface is uniformly charged is subjected to scanning exposure by a laser beam 37 modulated by an image signal by the laser beam scanner 3.

The laser beam scanner 3 is equipped with a semiconductor laser therein. The semiconductor laser is controlled in response to an original image information signal output from an original scanning device including a photoelectric conversion element such as a charge coupled device (CCD) and emits the laser beam 37.

As a result, surface potential of the photosensitive drum 1 charged by the charging apparatus 2 changes in an image portion, and the electrostatic latent image is formed on the surface of the photosensitive drum 1. The electrostatic latent image is reversal-developed by the developing apparatus 4, so that a visible image, that is, a toner image is generated. In the present embodiment, the developing apparatus 4 uses a two-component contact development system using a two-component developer in which a toner is mixed with a magnetic particle (carrier) as a developer. The image forming process is performed in each of the image forming portions P, and thus toner images of four colors, that is, yellow, magenta, cyan, and black are formed on the surfaces of the photosensitive drums 1.

In the present embodiment, an intermediate transfer belt 5 serving as an intermediate transfer member is arranged below the image forming portions P in FIG. 1. The intermediate transfer belt 5 is suspended by rollers 61, 62, and 63 and movable in an arrow direction in FIG. 1.

The toner image on the surface of the photosensitive drum 1 is primarily transferred onto an outer circumferential surface of the intermediate transfer belt 5 serving as the intermediate transfer member through the primary transfer roller 6 serving as the primary transfer portion. As a result, the toner images of four colors, that is, yellow, magenta, cyan, and black are superimposed on the outer circumferential surface of the intermediate transfer belt 5, so that a full-color image is formed. Further, the toner that remains onto the surface of the photosensitive drum 1 without being transferred is scraped and collected by the cleaning apparatus 19.

The full-color image primarily transferred onto the outer circumferential surface of the intermediate transfer belt 5 is secondarily transferred onto a recording material 33 such as a sheet that is fed from a sheet cassette 12 to a feed roller 13 and conveyed through a feed guide 11 by an operation of a secondary transfer roller 10 serving as a secondary transfer portion. The toner that remains on the outer circumferential surface of the intermediate transfer belt 5 without being transferred is scraped and collected by the cleaning apparatus 18.

Meanwhile, the recording material 33 on which the toner images on the outer circumferential surface of the intermediate transfer belt 5 are secondarily transferred is fed to a fixing apparatus 16 including a heating roller fixing apparatus serving as a fixing portion, and the toner images are fixed onto the recording material 33 by heating and pressing by the fixing apparatus 16. Thereafter, the recording material 33 is discharged onto a discharge tray 17.

Here, in the present embodiment, the photosensitive drum 1 configured with a drum-like organic photosensitive element that is commonly used has been used as the image bearing member. Besides, an inorganic photosensitive element such as an amorphous silicon photosensitive element may be used. Further, a belt-like photosensitive element may be used. A charging system, a transfer system, a cleaning system, and a fixing system need not be limited to the present embodiment.

<Developing Apparatus>

Figure 2:
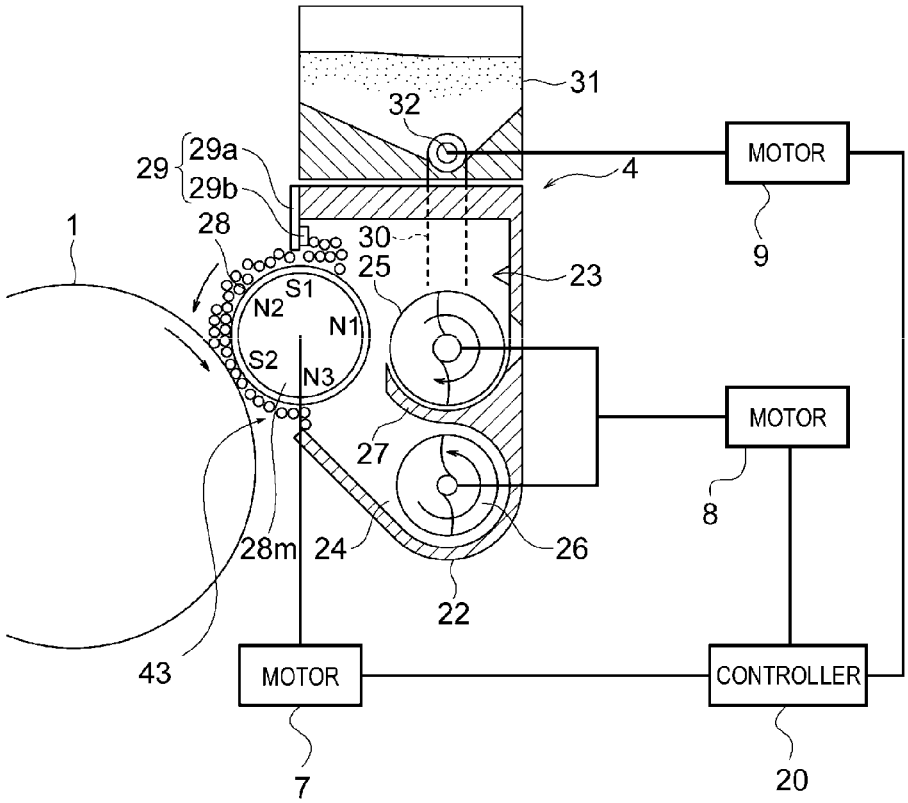
FIG. 2 is an explanatory vertical cross-sectional view illustrating a configuration of a developing apparatus according to the present invention.
Figure 3:
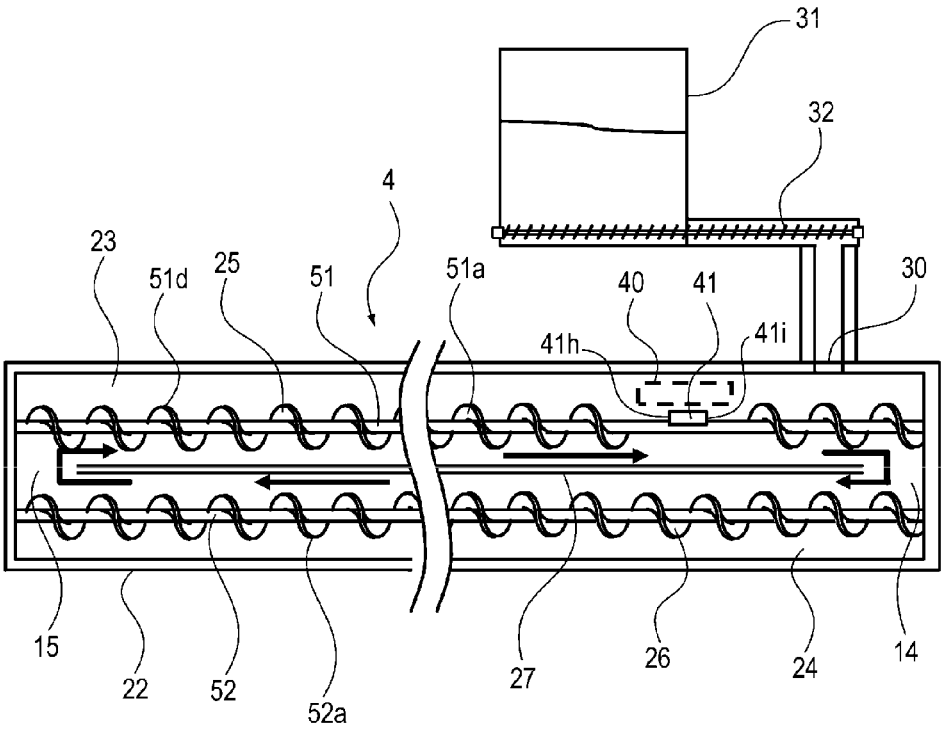
FIG. 3 is an explanatory horizontal cross-sectional view illustrating a configuration of a developing apparatus according to the present invention.

Next, a configuration and an operation of the developing apparatus 4 will be described with reference to FIGS. 2 and 3. FIGS. 2 and 3 are explanatory vertical and horizontal cross-sectional views of the developing apparatus 4 according to the present embodiment. The developing apparatus 4 according to the present embodiment includes a developing container 22 that accommodates a two-component developer including a toner and a magnetic particle (carrier) as illustrated in FIGS. 2 and 3. A two-component developer including a toner and a magnetic particle (carrier) is accommodated in the developing container 22 as a developer. Further, a developing sleeve 28 serving as a developer bearing member is rotatably arranged in the developing container 22 to face an opening portion 43 of the developing container 22. In addition, a regulating blade 29 serving as an ear-breaking member that regulates the ear of the developer borne on the surface of the developing sleeve 28 is arranged.

A partition 27 of which substantially central portion extends in a direction vertical to a paper plane of FIG. 3 is installed in the developing container 22 as illustrated in FIG. 3. The developing container 22 is vertically divided into a developing room 23 and an agitating room 24 by the partition 27 in FIGS. 2 and 3. Communication portions 14 and 15 serving as an opening are formed at both end portions of the partition 27. The developing room 23 and the agitating room 24 are configured as a circulation path in which the developer supplied to the developing sleeve 28 through the communication portions 14 and 15 are circulated while being agitated. The developer is accommodated in the developing room 23 and the agitating room 24.

First and second conveying screws 25 and 26 serving as a conveying member of conveying the developer are arranged in the developing room 23 and the agitating room 24, respectively. The first conveying screw 25 is arranged at the bottom of the developing room 23 almost in parallel to an axial direction of the developing sleeve 28. The first conveying screw 25 rotates in an arrow direction (a clockwise direction) of FIG. 2 to supply the developer in the developing room 23 to the developing sleeve 28 and convey the developer in one direction along a shaft line direction of a screw shaft 51 serving as a rotating shaft.

An outlet 40 through which part of the circulating developer overflows and is discharged from the circulation path is formed on the circulation path of the developing room 23 configuring the circulation path of the developer. The screw shaft 51 is rotatably installed on the circulation path facing the outlet 40 formed in the developing room 23.

The second conveying screw 26 is arranged at the bottom of the agitating room 24 almost in parallel to the first conveying screw 25. The second conveying screw 26 rotates in a direction (a counterclockwise direction) opposite to that of the first conveying screw 25, and collects the developer that has been subjected to the development. Further, the second conveying screw 26 conveys the developer in the agitating room 24 in the direction opposite to that of the first conveying screw 25.

As described above, the developer is conveyed by the rotation of the first and second conveying screws 25 and 26 while circulating between the developing room 23 and the agitating room 24 through the communication portions 14 and 15 serving as the openings at both end portions of the partition 27.

Figure 4:
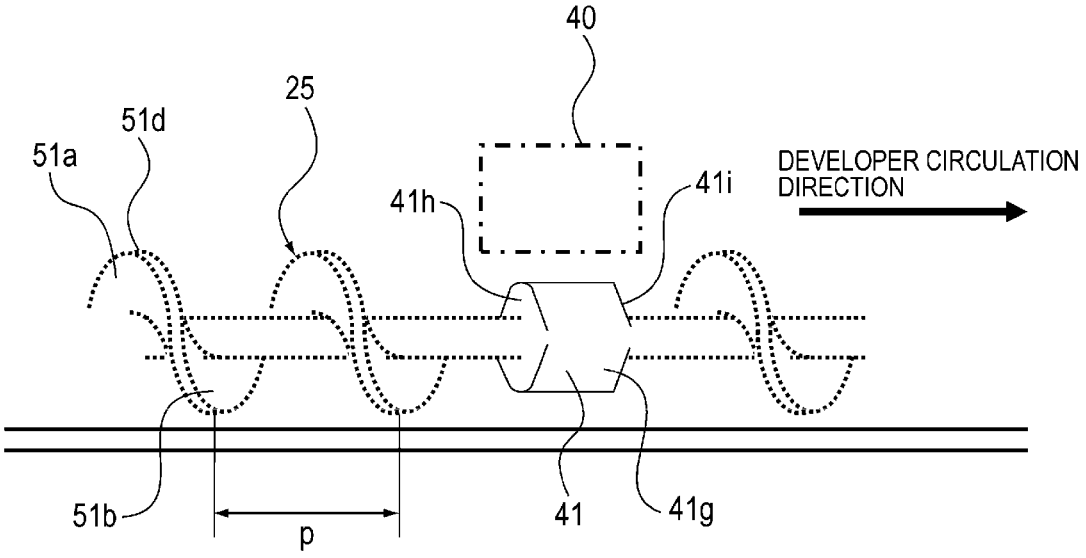
FIG. 4 is an explanatory cross-sectional view illustrating a configuration of a developing apparatus according to the present invention.

In the first and second conveying screws 25 and 26, screw blades 51*a* and 52*a* having an outer diameter of 18 mm are helically wound on the screw shafts 51 and 52 having an outer diameter of 6 mm. A helical pitch p in the direction of each of the screw shafts 51 and 52 of the screw blades 51*a* and 52*a* is 40 mm as illustrated in FIG. 4.

<Configuration of Drive Control System>

Next, a configuration of a drive control system of the developing apparatus 4 will be described with reference to FIG. 2. The developing sleeve 28 is rotationally driven by a motor 7 serving as a driving portion. The first and second conveying screws 25 and 26 are rotationally driven by a motor 8 serving as a driving portion. In the present embodiment, a DC motor is used as the motors 7 and 8. In the present embodiment, the motors 7 and 8 are driven and controlled by a controller 20.

At a time of image forming, a rotation speed of the motor 7 in a stationary state is set to 300 rotation per minute (rpm), and a rotation speed of the motor 8 is set to 700 rpm. In the present embodiment, the motors 7 and 8 are connected directly to the developing sleeve 28 and the first conveying screw 25, respectively. The first conveying screw 25 and the second conveying screw 26 are coupled through a gear train (not illustrated) having a gear ratio of 1:1.07 and rotationally driven.

In the present embodiment, there is the opening portion 43 at the position of the developing container 22 corresponding to a development region facing the photosensitive drum 1, and the developing sleeve 28 is rotatably arranged in the opening portion 43 to be partially exposed in the direction of the photosensitive drum 1. The developing sleeve 28 has an outer diameter of 20 mm, and is rotationally driven at a rotation speed of 300 rpm. The photosensitive drum 1 has an outer diameter of 30 mm and a rotation speed of 120 rpm.

A separation distance of about 400 μm is set to the nearest region of the developing sleeve 28 and the photosensitive drum 1. Thus, the setting is performed so that the development is performed by the developer conveyed to the developing portion in which the developing sleeve 28 faces the photosensitive drum 1 in a state in which the developing sleeve 28 comes into contact with the photosensitive drum 1.

The developing sleeve 28 according to the present embodiment is made of a non-magnetic material such as aluminum or stainless steel, and a magnet roller 28*m* serving as a magnetic field generating portion is arranged in the developing sleeve 28 in a non-rotation state. The developing sleeve 28 rotates in the arrow direction (the counterclockwise direction) of FIG. 2 at the time of development. The developing sleeve 28 bears the two-component developer of which layer thickness is regulated by ear-breaking of a magnetic brush by the regulating blade 29. The two-component developer is conveyed to the development region facing the photosensitive drum 1, and supplied to the electrostatic latent image formed on the surface of the photosensitive drum 1, so that the electrostatic latent image is developed as the toner image.

The regulating blade 29 is configured with a non-magnetic member 29*a* made of plate-like aluminum or the like extending along a shaft line in the longitudinal direction of the developing sleeve 28 and a magnetic member 29*b* made of an iron material or the like. The amount of the developer to be conveyed to the development region is adjusted by adjusting a gap between the regulating blade 29 and the surface of the developing sleeve 28. In the present embodiment, the regulating blade 29 regulates a developer coating amount per unit area on the surface of the developing sleeve 28 to 30 mg/cm$^2$. Here, the gap between the regulating blade 29 and the developing sleeve 28 is appropriately set to a range of 200 μm to 1000 μm, preferably, a range of 300 μm to 700 μm. In the present embodiment, the gap between the regulating blade 29 and the developing sleeve 28 is set to 400 μm.

<Two-Component Developer>

Next, the two-component developer including the toner and the magnetic particle (carrier) used in the present embodiment will be described. The toner includes a coloring resin particle containing binder resin, a colorant, and other additives as necessary and a coloring particle to which an external additive such as a colloidal silica fine power is externally added. Preferably, the toner is negatively charged polyester-based resin, and has a volume average particle diameter of 4 μm or more and 10 μm or less. More preferably, the toner has a volume average particle diameter of 8 μm or less.

For example, metal such as iron, nickel, cobalt, manganese, chromium, or a rare-earth element of surface oxidation or no oxidation, an alloy thereof, ferrite oxide, or the like can be preferably used as the magnetic particle (carrier). A method of manufacturing the magnetic particle is not particularly limited. An average particle diameter of the magnetic particle (carrier) is 20 μm to 60 μm, preferably, 30 μm to 50 μm, and resistivity of the magnetic particle (carrier) is $1\times10^7$ Ωcm or more, preferably, $1\times10^8$ Ωcm or more. In the present embodiment, the magnetic particle (carrier) having the resistivity of $1\times10^8$ Ωcm is used.

<Developer Supply Method>

Next, a developer supply method according to the present embodiment will be described with reference to FIGS. 2 and 3. A hopper 31 serving as a supply portion that accommodates the two-component developer for supply in which the toner is mixed with the magnetic particle (carrier) is arranged above the developing apparatus 4 as illustrated in FIGS. 2 and 3. The hopper 31 serving as the supply portion supplies at least the magnetic particle (carrier) to the developing room 23 serving as the circulation path.

The hopper 31 includes a screw-like supply screw 32 serving as a conveying member arranged in its lower portion, and one end of the supply screw 32 extends up to the position of a supply port 30 formed at a right end portion of the developing apparatus 4 in FIG. 3.

The toner corresponding to the amount consumed by image forming is supplied from the hopper 31 to the inside of the developing container 22 through the supply port 30 by rotational force of the supply screw 32 and gravity of the developer. As described above, the supply developer is supplied from the hopper 31 to the developing apparatus 4. The supply amount of the supply developer is approximately decided according to the number of revolutions of the supply screw 32. The number of revolutions of the supply screw 32 is decided by the controller 20 that controls a motor 9 serving as a drive source that rotationally drives the supply screw 32 and functions as a toner supply amount controller.

As a method of controlling a toner supply amount, various methods such as a method of detecting the toner density of the two-component developer optically or magnetically or a method of developing a reference latent image on the surface of the photosensitive drum 1 and detecting the density of the toner image may be applied.

<Developer Discharging Method>

Next, a developer discharging method according to the present embodiment will be described with reference to FIG. 3. The outlet 40 configuring a developer discharging portion is formed outside an installation region of the developing sleeve 28 at the downstream of the developing room 23 in the developer circulation direction. The developer is discharged through the outlet 40.

When the developer in the developing apparatus 4 is increased through the developer supply process, the developer overflows and is discharged from the outlet 40 according to an amount of increase. Here, the outlet 40 is formed at the position at the upstream side higher than the position the supply port 30 of the developer in the developer conveying direction. It is to prevent the new developer supplied from the supply port 30 from being immediately discharged from the outlet 40.

Figure 6:
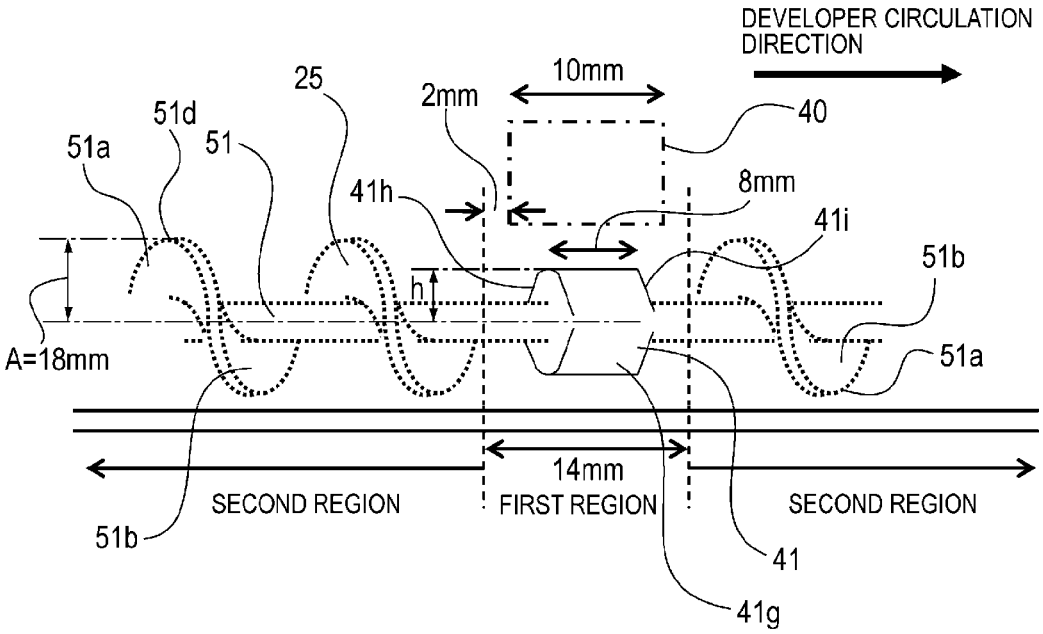
FIG. 6 is an explanatory cross-sectional view for describing a configuration of a developing apparatus around an outlet according to the present invention.

FIG. 6 is a diagram for describing a portion of the first conveying screw 25 facing the outlet 40 in the present embodiment. In the present embodiment, a rib member 41 having a small diameter serving as a protruding portion and the screw blade 51*a* serving as a blade portion are installed around the screw shaft 51 of the first conveying screw 25. The first conveying screw 25 includes at least a first region with a facing portion facing the outlet 40 and a second region adjacent to the first region in the shaft line direction of the screw shaft 51 as illustrated in FIG. 6.

In the present embodiment, the screw blade 51*a* of the first region serving as a portion facing the outlet 40 is omitted. In the portion, the rib member 41 of the small diameter that vibrates the developer is installed in parallel to the shaft line direction of the screw shaft 51. The rib member 41 formed in the first region illustrated in FIG. 6 is formed to have an outer diameter smaller than the screw blade 51*a* formed in the second region. Here, when the screw blade 51*a* of the second region is not constant, the outer diameter of the rib member 41 is preferably formed to be smaller than a maximum outer diameter of the screw blade 51*a*.

In the present embodiment, the length of the first region in which the screw blade 51*a* of the first conveying screw 25 is omitted in the shaft line direction of the screw shaft 51 is 14 mm as illustrated in FIG. 6. The length of the outlet 40 in the shaft line direction of the screw shaft 51 is 10 mm. The length of the rib member 41 serving as the protruding portion in the shaft line direction of the screw shaft 51 is 8 mm.

The center of the first region in which the screw blade 51*a* is omitted in the shaft line direction of the screw shaft 51, the center of the outlet 40 in the shaft line direction of the screw shaft 51, and the center of the rib member 41 in the shaft line direction of the screw shaft 51 are as follows. The centers are arranged at the positions to match in the shaft line direction of the screw shaft 51.

Figure 7:
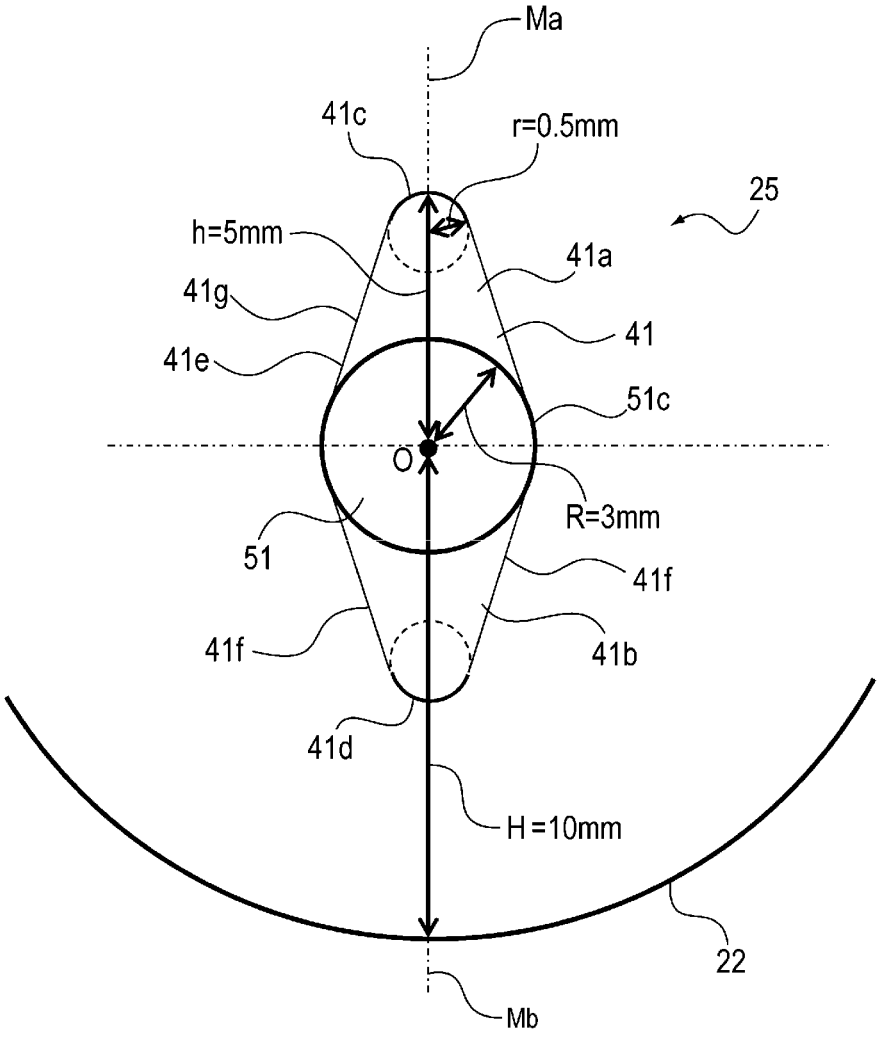
FIG. 7 is an explanatory cross-sectional view for describing a configuration of a developing apparatus around an outlet according to the present invention.

The rib member 41 according to the present embodiment is configured to have a cross-sectional shape of substantially an elliptical shape as illustrated in FIG. 7. The cross section of the rib member 41 gradually gets finer as it approaches the front end of the screw shaft 51 from the base thereof. The screw shaft 51 of the first conveying screw 25 has an outer diameter radius R of 3 mm as illustrated in FIG. 7. A height h of the rib member 41 from a rotational center o of the screw shaft 51 is 5 mm. The height h (=5 mm) of the rib member 41 from the rotational center o of the screw shaft 51 is smaller than a height A (=18 mm) of the screw blade 51*a* from the rotational center o of the screw shaft 51 illustrated in FIG. 6.

An installation height H of the first conveying screw 25 from the rotational center o of the screw shaft 51 to the bottom of the developing container 22 is 10 mm as illustrated in FIG. 7.

The rib member 41 includes two long axis portions 41*a* and 41*b* that protrude from the screw shaft 51 in opposite directions as illustrated in FIG. 7. The front end portion of the rib member 41 is configured to include semi-circular portions 41*c* and 41*d* having a radius r of 0.5 mm. Further, the rib member 41 is configured to include an outer circumferential portion 51*c* of the screw shaft 51 and tangent line portions 41*e* and 41*f* coming into contact with the semi-circular portions 41*c* and 41*d* of the front end portion. The long axis portions 41*a* and 41*b* of the rib member 41 are linearly symmetric with respect to straight lines Ma and Mb passing through the rotational center o of the screw shaft 51 and the apexes of the semi-circular portions 41*c* and 41*d* of the front end portion, and form an angle of 180° with the straight line Ma and the straight line Mb.

The installation phase of the rib member 41 with respect to the first conveying screw 25 is assumed to be constant and the same in the shaft line direction of the screw shaft 51. Through this configuration, as the first conveying screw 25 rotates, the rib member 41 vibrates the developer in the portion facing the outlet 40, crumbles and smooths the developer, and thus prevents a local increase in a developer level. As a result, the developer is prevented from overflowing from the outlet 40 at a time, whereby the developer is stably discharged.

Generally, when an average angle of an angle formed by a conveying surface 41*g* for developer conveyance of the rib member 41 formed in the first region and the shaft line direction of the screw shaft 51 of the first conveying screw 25 is set as follows, an effect of smoothing the developer is obtained. When the an average angle formed by the conveying surface 41*g* and the shaft line direction of the screw shaft 51 is set to be smaller than an average angle of an angle formed by a conveying surface 51*b* for developer conveyance of the screw blade 51*a* formed in the second region adjacent to the first region and the shaft line direction of the screw shaft 51, an effect of smoothing the developer is obtained.

In this regard, in the present embodiment, since the conveying surface 41*g* for the developer conveyance of the rib member 41 and the shaft line direction of the screw shaft 51 of the first conveying screw 25 are set to be parallel to each other, the average angle of the angle formed by the conveying surface 41*g* and the shaft line direction of the screw shaft 51 is 0° as illustrated in FIG. 7. The average angle of the angle formed by the conveying surface 51*b* for developer conveyance of the screw blade 51*a* and the shaft line direction of the screw shaft 51 is about 60° as illustrated in FIG. 8.

Figure 8:
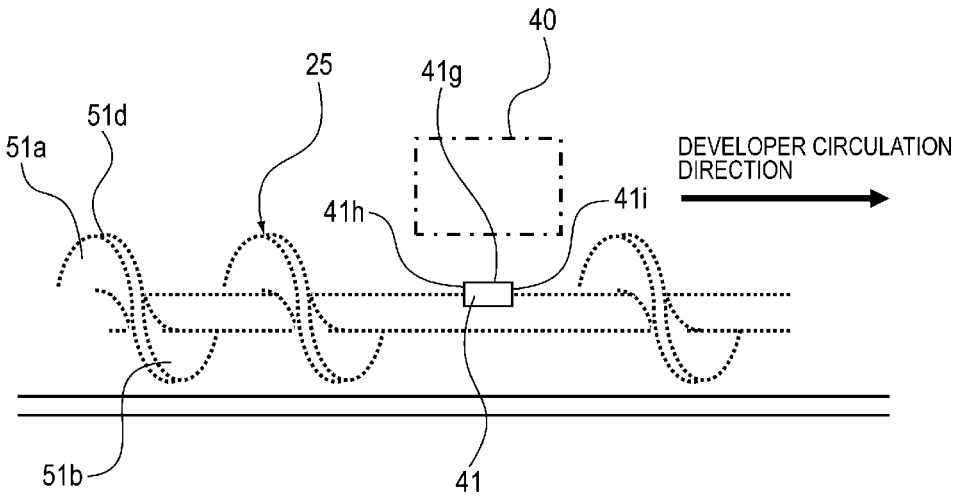
FIG. 8 is an explanatory cross-sectional view for describing another configuration of a developing apparatus according to the present invention.
Figure 9:
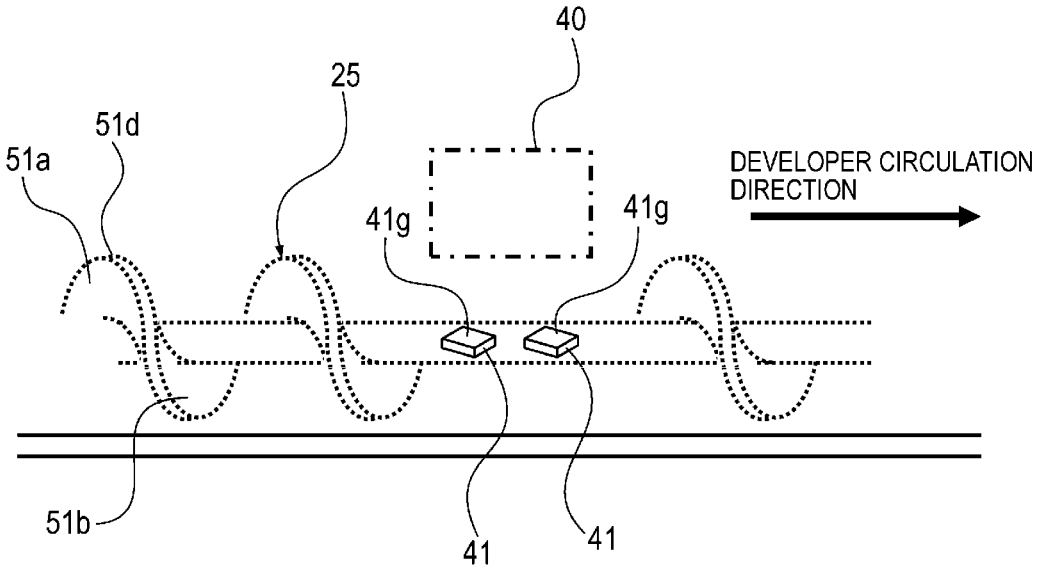
FIG. 9 is an explanatory cross-sectional view for describing another configuration of a developing apparatus according to the present invention.

For example, the rib member 41 may have a rectangular cross section along the shaft line direction of the screw shaft 51 as illustrated in FIG. 8 or rectangular cross sections as illustrated in FIG. 9, and may have a small angle with respect to the shaft line direction of the screw shaft 51.

At this time, an inclination angle of the rib member 41 with respect to the shaft line direction of the screw shaft 51 is set to be excessively large. In this case, the average angle of the angle formed by the conveying surface 41*g* for the developer conveyance of the rib member 41 formed in the first region illustrated in FIG. 6 and the shaft line direction of the screw shaft 51 of the first conveying screw 25 is as follows. The average angle of the angle formed by the conveying surface 41*g* and the shaft line direction of the screw shaft 51 becomes larger than the average angle of the angle formed by the conveying surface 51*b* for developer conveyance of the screw blade 51*a* formed in the second region adjacent to the first region and the shaft line direction of the screw shaft 51, and thus an effect of smoothing the developer is unlikely to be obtained.

Figure 10:
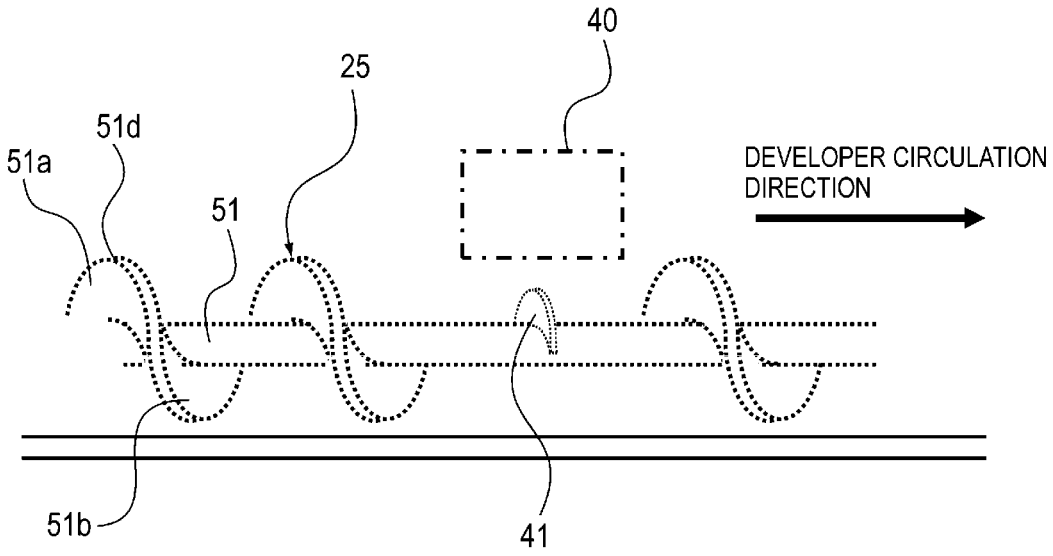
FIG. 10 is an explanatory cross-sectional view for describing another configuration of a developing apparatus according to the present invention.

Here, when the effect of smoothing the developer is not the premise, the rib member 41 is configured to have a diameter simply smaller than the outer diameter of the screw blade 51*a* in the second region adjacent to the first region in which at least the rib member 41 is installed as illustrated in FIG. 6. The rib member 41 illustrated in FIG. 10 is configured in a part of the helical blade portion having the diameter smaller than the outer diameter of the screw blade 51*a* in the second region adjacent to the first region in which the rib member 41 is installed.

Figure 5:
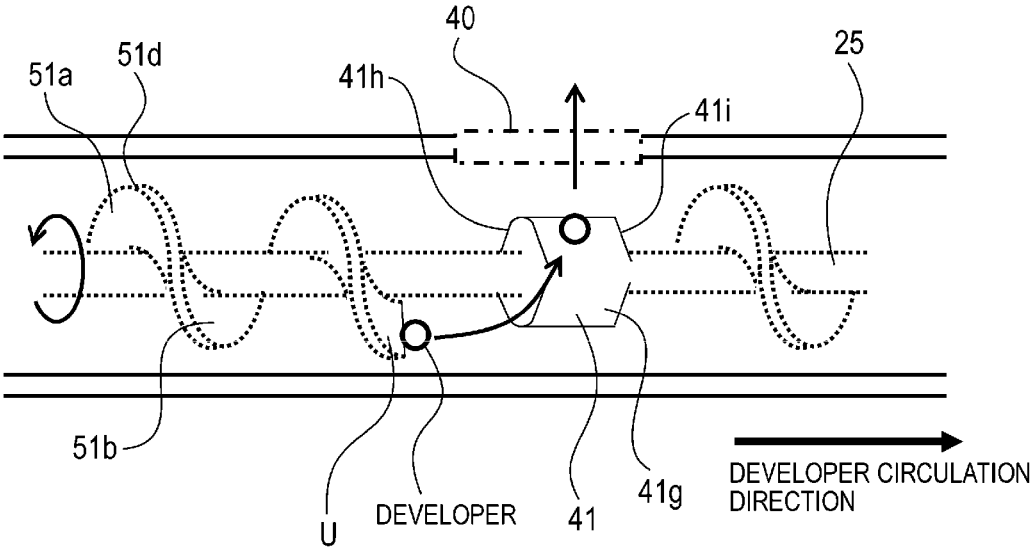
FIG. 5 is an explanatory cross-sectional view for describing a problem of a developing apparatus according to a comparative example.

However, when this rib member 41 is installed, the following problem arises according to the installation phase in the rotation direction of the first conveying screw 25 as illustrated in FIG. 5. Even when the developer is not churned up by the rib member 41, the developer hoisted by a downstream end portion U of the screw blade 51*a* in the second region adjacent to the upstream side of the first region facing the outlet 40, and collides with the rib member 41. As a result, the developer is churned up, and overflows from the outlet 40.

Figure 11:
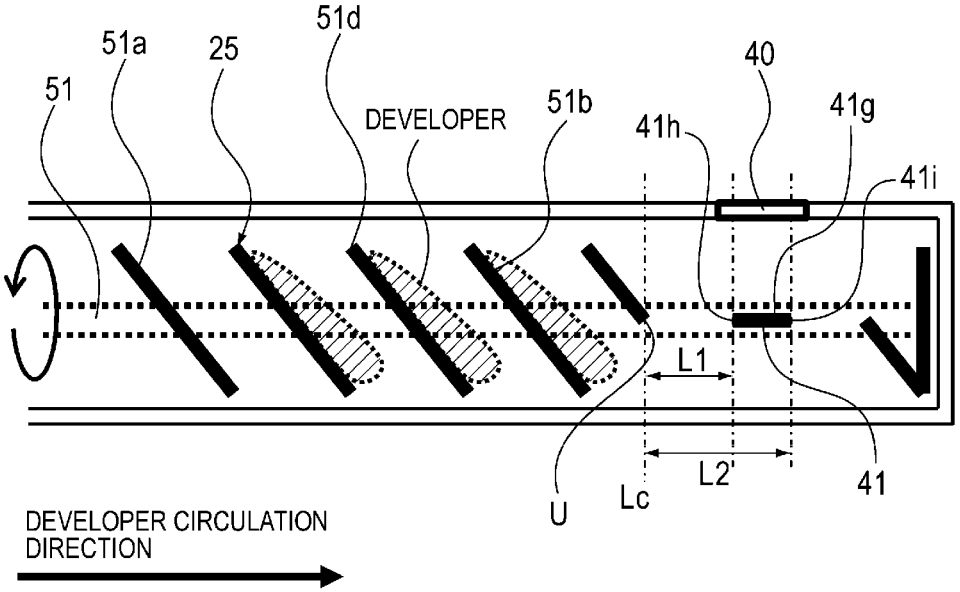
FIG. 11 is an explanatory cross-sectional view for describing an operation of a developer around an outlet of a developing apparatus according to the present invention.

FIG. 11 is a diagram illustrating an area around the outlet 40 viewed from the top. As illustrated in FIG. 11, the developer rides the conveying surface 51*b* of the screw blade 51*a* and is conveyed to the downstream side (the right side in FIG. 11) in the developer circulation direction. The developer reaches a border line Lc serving as a border portion in which the developer enters the first region in which the screw blade 51*a* is omitted from the second region in which the screw blade 51*a* is installed. In this case, the developer is affected by force in the rotation direction of the first conveying screw 25 by the downstream end portion U of the screw blade 51*a* of the border line Lc portion, and slightly changes its path as illustrated in FIG. 12.

Figure 12:
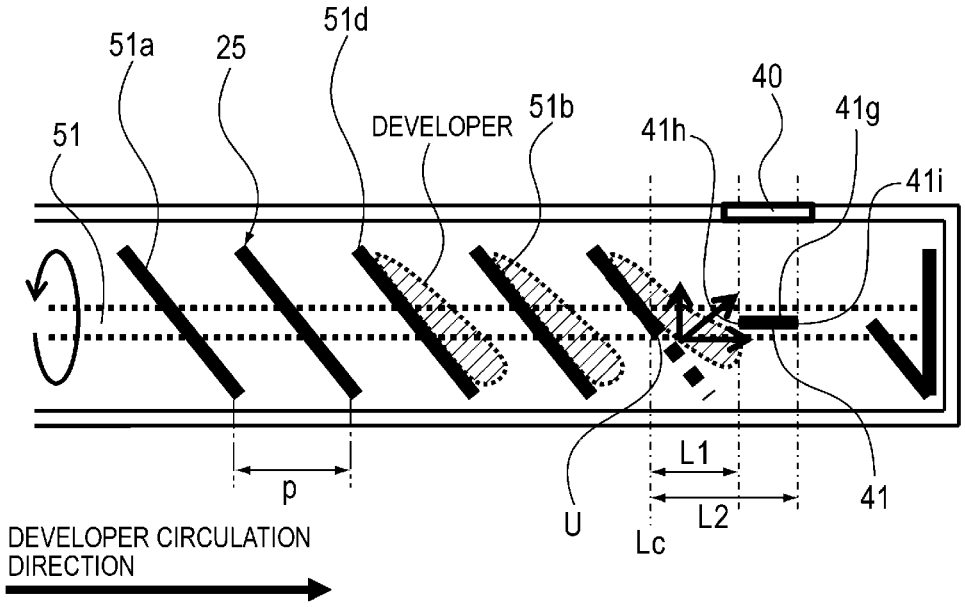
FIG. 12 is an explanatory cross-sectional view for describing an operation of a developer around an outlet of a developing apparatus according to the present invention.

Here, distances L1 and L2 illustrated in FIGS. 11 and 12 are as follows. The distances L1 and L2 are distances between the border line Lc serving as an end point of the first region at the uppermost stream side of the circulation path and an upstream end portion 41*h* and a downstream end portion 41*i* of the rib member 41 in the shaft line direction of the screw shaft 51 (the crosswise direction in FIGS. 11 and 12), respectively. The upstream end portion 41*h* is an end point of the rib member 41 formed in the first region at the upstream side (the left side in FIGS. 11 and 12) in the developer circulation direction. The downstream end portion 41*i* is an end point of the rib member 41 at the downstream side (the right side in FIGS. 11 and 12) in the developer circulation direction.

In other words, the distances L1 and L2 are distances in the shaft line direction of the screw shaft 51 from the border line Lc passing through the downstream end portion U of the screw blade 51*a* in the second region adjacent to the upstream side of the first region facing the outlet 40 to the upstream end portion 41*h* and the downstream end portion 41*i* of the rib member 41.

A speed component applied to a rotation direction component of the screw blade 51*a* by the downstream end portion U of the screw blade 51*a* differs according to the circumstances. A maximum speed is the same speed as the speed of the downstream end portion U of the screw blade 51*a* in the rotation direction of the screw blade 51*a*. A minimum speed is zero. In other words, it is the case in which no force is applied in the rotation direction of the screw blade 51*a* by the downstream end portion U of the screw blade 51*a*, and it passes through in the shaft line direction of the screw shaft 51 without stopping.

In other words, if the rotation speed of the first conveying screw 25 is ωr [rotations per second (rps)], and the rotation speed applied to the developer by the downstream end portion U of the screw blade 51*a* is ωd, a relation indicated by the following Formula 1 is obtained.

$$0 \leq \omega d \leq \omega r \qquad \text{[Math. 1]}$$

Meanwhile, the developer receives force from the downstream end portion U of the screw blade 51*a*, and plunges into the portion in which the screw blade 51*a* is omitted. The moving velocity of the developer in the shaft line direction of the screw shaft 51 at that time is substantially the same as the moving velocity of the screw blade 51*a* regardless of the speed component applied to the rotation direction component of the screw blade 51*a* by the downstream end portion U of the screw blade 51*a*.

Thus, a time t(x) taken until the developer is churned up by the downstream end portion U of the screw blade 51*a*, and then reaches a distance x in the shaft line direction of the screw shaft 51 based on the border line Lc is as follows. The border line Lc is a border line with the portion in which the screw blade 51*a* is omitted, which serves as an end point of the first region at the uppermost stream side of the circulation path. If the helical pitch of the screw blade 51*a* of the first conveying screw 25 is p, the time t(x) is represented by the following Formula 2 using the rotation speed ωr of the first conveying screw 25. Here, when the helical pitch of the screw blade 51*a* of the first conveying screw 25 is not constant, the pitch p substituted into Formula 2 is replaced with a screw pitch at the direct upstream of the first region.

$$t(x) = x/(p \times \omega r) \qquad \text{[Math. 2]}$$

Thus, at this time, a rotational angle θs of the first conveying screw 25 and an angle θd at which the developer churned up by the downstream end portion U of the screw blade 51*a* rotates are as follows. The rotational angle θs and the angle θd are obtained by Formula 2 and the following Formula 3, respectively, using the rotation speed ωd applied to the developer by the downstream end portion U of the screw blade 51*a*.

$$\theta s = 360 \times t(x) \times \omega r = 360 \times (x/p)$$

$$\theta d = 360 \times t(x) \times \omega d = 360 \times (x\omega d/p\omega r) = (\omega d/\omega r) \times \theta s \qquad \text{[Math. 3]}$$

Figure 13:
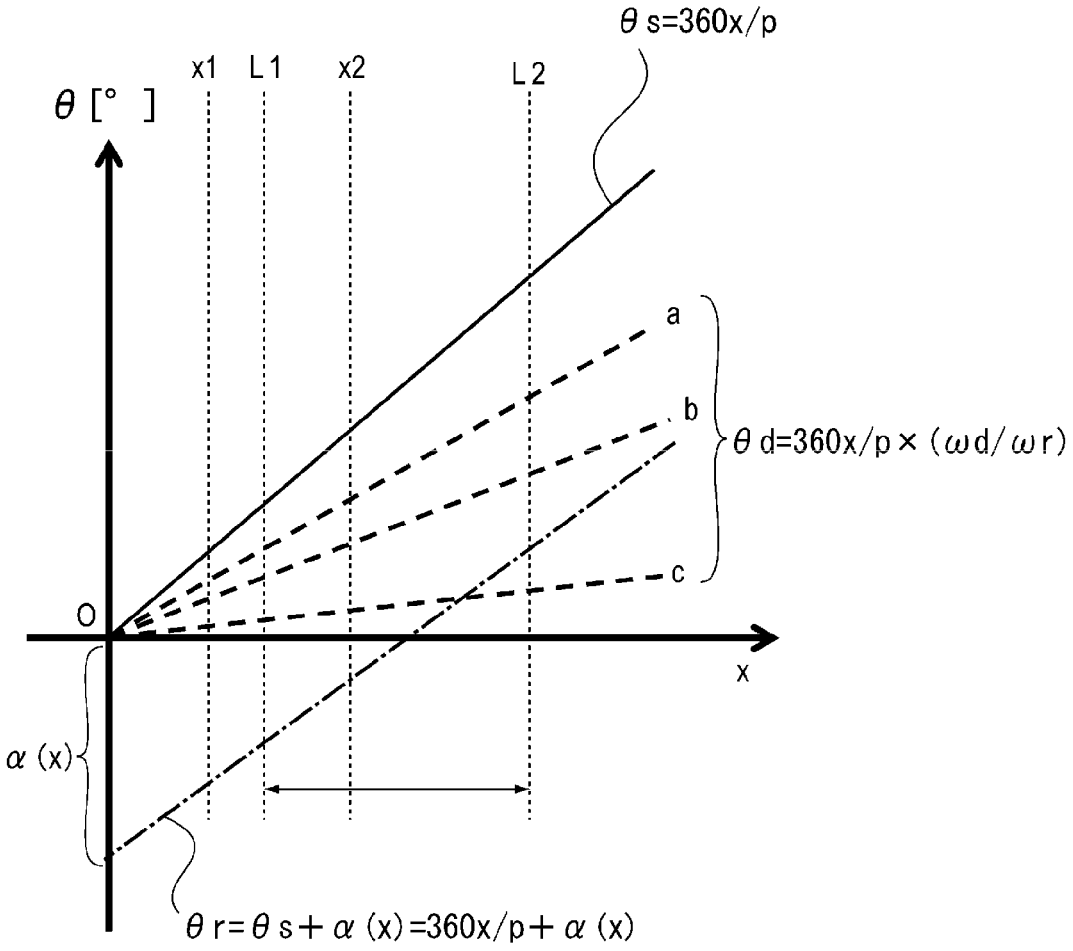
FIG. 13 is a diagram for describing a condition in which a developer is churned up by a protruding portion.

A horizontal axis of FIG. 13 indicates the distance x in the shaft line direction of the screw shaft 51 from the border line Lc with the portion in which the screw blade 51*a* is omitted. Further, a vertical axis of FIG. 13 indicates a rotational angle θ until the developer is churned up by the downstream end portion U of the screw blade 51*a* and then reaches the position corresponding to the distance x. The developer churned up by the downstream end portion U of the screw blade 51*a* reaches the position corresponding to the distance x in the shaft line direction of the screw shaft 51 from the border line Lc. The rotational angle θs of the first conveying screw 25 at that time and the angle θd at which the developer churned up by the downstream end portion U of the screw blade 51*a* rotates become a graph illustrated in FIG. 13.

Each of straight line a, b, and c illustrated in FIG. 13 indicates an example of the angle θd at which the developer churned up by the downstream end portion U of the screw blade 51*a* rotates. The straight lines a, b, and c are examples that differ in the value of the rotation direction component of the first conveying screw 25 which the developer receives from the downstream end portion U of the screw blade 51*a*.

(ωd/ωr) shown in the last term of Formula 3 is 1 or less from the relation of Formula 1. Thus, the angle θd at which the developer churned up by the downstream end portion U of the screw blade 51*a* rotates is the rotational angle θs of the first conveying screw 25 or less. Thus, the angle θd at which the developer churned up by the downstream end portion U of the screw blade 51*a* rotates is present in a region surrounded by the straight lines of the rotational angle θs of the first conveying screw 25 illustrated in FIG. 13 and the horizontal axis at which a value of x illustrated in FIG. 13 is 0 or more.

Figure 14:
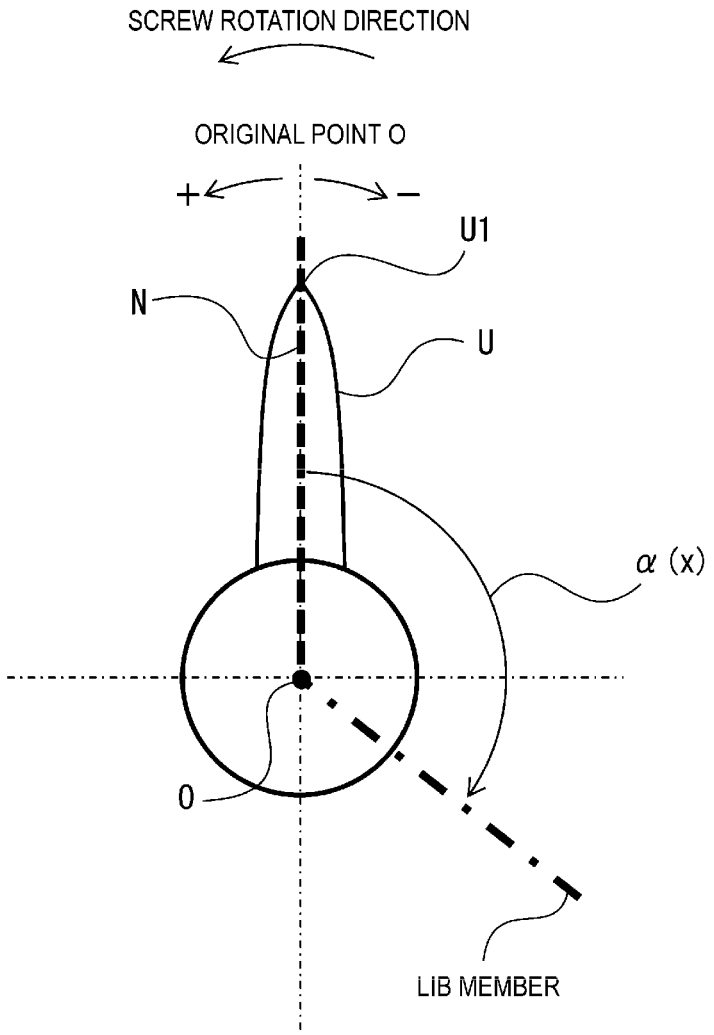
FIG. 14 is a diagram for describing a condition in which a developer is churned up by a protruding portion.

In the graph illustrated in FIG. 13, a point at which the developer is churned up by the downstream end portion U of the screw blade 51*a* of the screw blade 51*a* is set as an original point O. Further, for example, a straight line N connecting a circumferential point U1 of the screw blade 51*a* to the downstream end portion U of the screw blade 51*a* in the second region adjacent to the upstream side of the first region with the rotational center o of the screw shaft 51 is set as illustrated in FIG. 14. Furthermore, when the rotation direction of the first conveying screw 25 from the first straight line N centering on the rotational center o of the screw shaft 51 is assumed to be positive, the rib member 41 is installed at a phase angle α(x).

In this case, after the developer is churned up by the downstream end portion U of the screw blade 51*a*, the rib member 41 rotates, and the developer reaches the position corresponding to the distance x in the shaft line direction of the screw shaft 51 from the border line Lc. A reaching angle θr of the rib member 41 at that time is indicated by the following Formula 4 as indicated by a long dashed short dashed line of FIG. 13.

Figure 15:
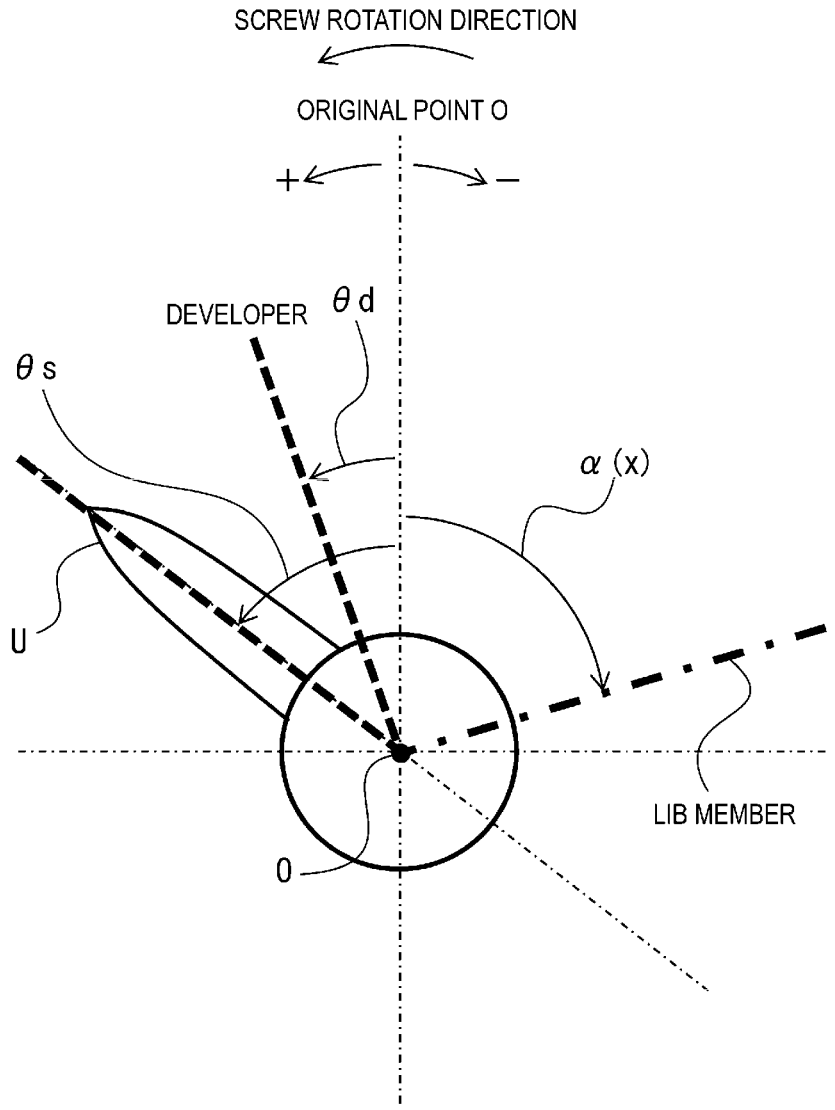
FIG. 15 is a diagram for describing a condition in which a developer is churned up by a protruding portion.
Figure 16:
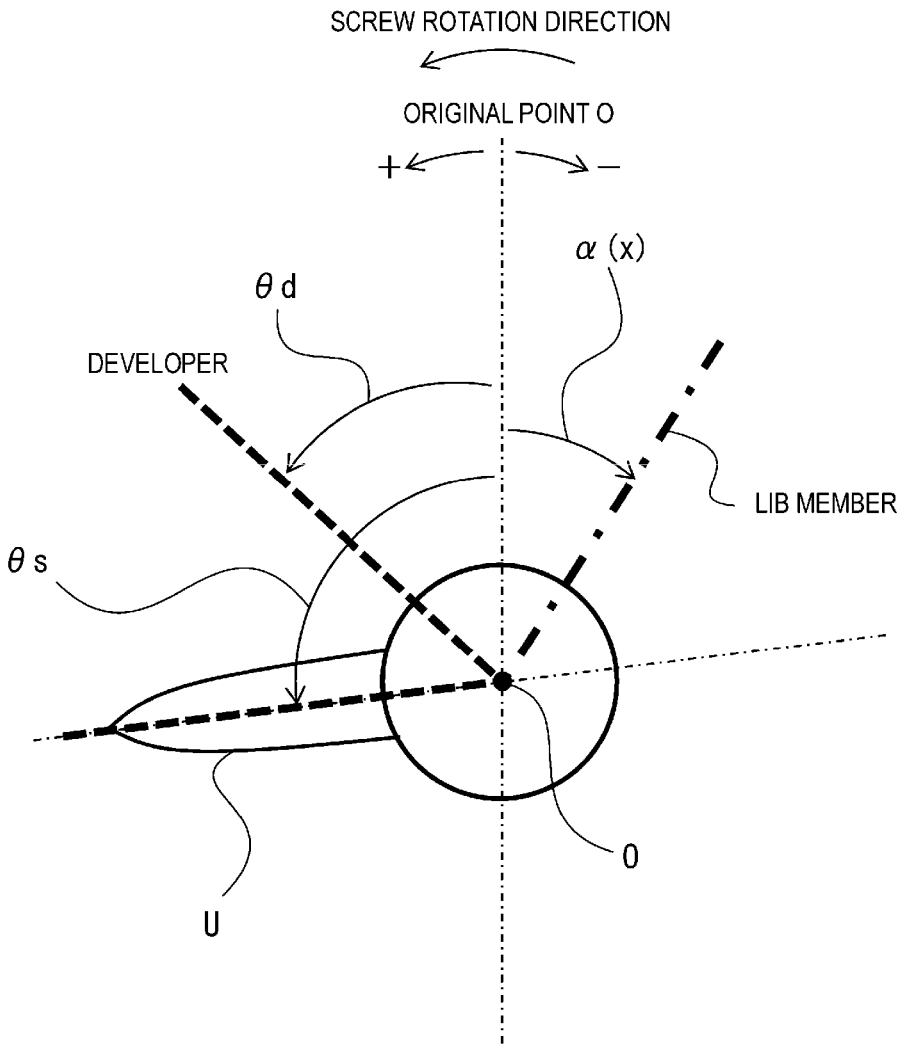
FIG. 16 is a diagram for describing a condition in which a developer is churned up by a protruding portion.

Here, the reaching angle θr is an angle in which the point at which the developer is churned up by the downstream end portion U of the screw blade 51*a* of the screw blade 51*a* is set as the original point O. Meanwhile, the rotational angles θs and θd illustrated in FIGS. 15 and 16 are the rotational angle of the screw blade 51*a* after the developer is churned up by the downstream end portion U of the screw blade 51*a*.

As illustrated in FIG. 13, based on the point at which the developer is churned up by the downstream end portion U of the screw blade 51*a*, that is, the original point O, the reaching angle and the rotational angles θs and θd of the first conveying screw 25 and the developer when the developer is at the position corresponding to the distance x are considered to match each other. As illustrated in FIG. 14, the phase angle α(x) at which the rib member 41 is installed when the rotation direction of the first conveying screw 25 is assumed to be positive is an angle in a negative rotation direction from the original point O.

Here, in the following Formula 4, a phase angle at which the rib member 41 is installed when the rotation direction of the first conveying screw 25 is assumed to be positive is represented by α(x) serving as a function of x. The reason is because there are cases in which the phase angle at which the rib member 41 is installed depends on the position (the position corresponding to the distance x in the shaft line direction of the screw shaft 51 from the border line Lc) in the shaft line direction of the screw shaft 51.

$$\theta r=\theta s+\alpha(x) \qquad \text{[Math. 4]}$$

FIGS. 14 to 16 are diagrams illustrating this using the cross-sectional view of the first conveying screw 25. FIGS. 14 to 16 illustrate a relation between the developer and the first conveying screw 25 at the angle θd at which the developer churned up by the downstream end portion U of the screw blade 51*a* rotates, which is indicated by the straight line b of FIG. 13.

FIG. 14 is a cross-sectional view illustrating a moment (x=0) in which the developer receives force applied from the downstream end portion U of the screw blade 51*a* in the border line Lc of the portion in which the screw blade 51*a* is omitted. FIGS. 15 and 16 are cross-sectional views at the positions corresponding to the distances x (=x1 and x2) in the shaft line direction of the screw shaft 51 based on the border line Lc of the portion in which the screw blade 51*a* is omitted. Here, in FIGS. 14 to 16, for the sake of convenience, a point (phase) at which the developer receives force applied by the downstream end portion U of the screw blade 51*a* in the second region adjacent to the upstream side of the first region (hereinafter, referred to simply as "the downstream end portion U of the screw blade 51*a*") is illustrated upward. Further, an "original point O" corresponds to the original point O of FIG. 13.

The speed at which the developer moves in the x direction indicated by the horizontal axis of FIG. 13 is represented by Formula 2. The developer is churned up by the downstream end portion U of the screw blade 51*a* and then moves in the shaft line direction of the screw shaft 51. Further, the developer rotates together with the first conveying screw 25. In FIGS. 14 to 16, an aspect of movement of the developer is illustrated together with the passage of time.

As illustrated in FIG. 14, a moment in which the developer receives force applied from the downstream end portion U of the screw blade 51*a* in the border line Lc portion of the portion in which the screw blade 51*a* is omitted is as follows. The position of the developer is the distance x (=0) of the developer in the shaft line direction of the screw shaft 51 from the border line Lc, and t(x) is 0 from Formula 2. At this time, the rotational angle of the developer and the first conveying screw 25 is 0° as illustrated in FIG. 14, and the phase angle α(x) of the rib member 41 is an angle illustrated in FIG. 14.

Referring to FIG. 15, the developer churned up by the downstream end portion U of the screw blade 51*a* is at the position at which the distance x of the developer in the shaft line direction of the screw shaft 51 from the border line Lc at a time t(x1) is x1 according to Formula 2. At this time (at the position of the distance x1), the developer, the first conveying screw 25, and the rib member 41 are at angles illustrated in FIG. 15.

Further, as a time elapses, the developer is at the position at which the distance x of the developer in the shaft line direction of the screw shaft 51 from the border line Lc at a time t(x2) is x2 according to Formula 2. At this time (at the position of the distance x2), the developer, the first conveying screw 25, and the rib member 41 are at angles illustrated in FIG. 16.

As can be seen from FIGS. 13 to 16, the developer churned up and hoisted by the downstream end portion U of the screw blade 51*a* is not further churned up by the rib member 41. Thus, preferably, the developer churned up by the downstream end portion U of the screw blade 51*a* is not overtaken by the rib member 41 while passing through the region which the rib member 41 is installed.

In other words, it is preferable that a relation represented by the following Formula 5 be satisfied at all xes of $L1 \leq x \leq L2$ illustrated in FIG. 13 using the distances L1 and L2 in the shaft line direction of the screw shaft 51 from the border line Lc between the upstream end portion 41*h* and the downstream end portion 41*i* of the rib member 41 illustrated in FIG. 12.

$$\theta d - \theta r = (\omega d/\omega r - 1) \times 360 \times (x/p) - \alpha(x) \neq 0 \quad \text{[Math. 5]}$$

Specifically, the straight lines a and b illustrated in FIG. 13 do not intersect with the straight line θr at all xes of $L1 \leq x \leq L2$ at the x axis indicated by the horizontal axis of FIG. 13 and thus satisfy the condition indicated by Formula 5. However, the straight line c illustrated in FIG. 13 intersects with the straight line θr at all xes of $L1 \leq x \leq L2$ at the x axis indicated by the horizontal axis of FIG. 13 and thus does not satisfy the condition indicated by Formula 5.

Thus, when the angle θd is indicated by the straight line c illustrated in FIG. 13, the angle θd at which the developer churned up by the downstream end portion U of the screw blade 51*a* rotates is as follows. The developer churned up by the downstream end portion U of the screw blade 51*a* passes through the region in which the rib member 41 is installed. During that time, the developer that is overtaken by the rib member 41 and churned up and hoisted by the downstream end portion U of the screw blade 51*a* is likely to be further churned up by the rib member 41 and overflow from the outlet 40.

Figure 17:
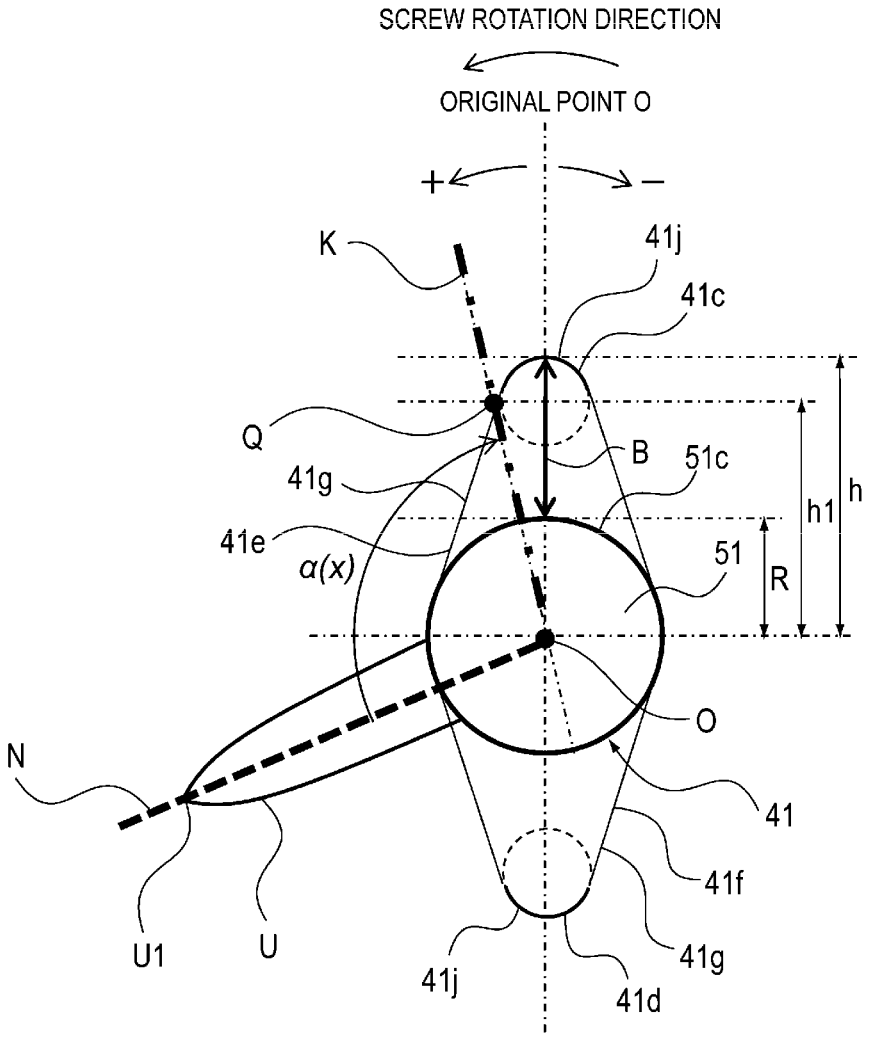
FIG. 17 is a diagram for describing a condition in which a developer is churned up by a protruding portion.

Practically, the rib member 41 has a certain thickness as illustrated in FIG. 17 instead of a long thin cross-sectional shape schematically illustrated in FIGS. 14 to 16. The developer receives force from the conveying surface 41*g* of the rib member 41 at the rotation direction upstream side illustrated in FIG. 17. Thus, it is preferable that only the conveying surface 41*g* of the rib member 41 be considered. The developer receives force through collision with the conveying surface 41*g* of the rib member 41, but although the developer collides with a point close to the base of the rib member 41, since the distance from the rotational center o of the screw shaft 51 is near, the developer does not receive force that is strong to cause the developer to leak from the outlet 40.

According to study performed by the present invention, as the developer gets closer to the front end side of the rib member 41, the speed at which the developer is churned up by force applied by collision increases. Generally, the following is considered based on the outer circumferential portion 51*c* (the rotating shaft outer circumference surface) of the screw shaft 51 serving as the rotating shaft of the rib member 41 illustrated in FIG. 17.

As illustrated in FIG. 17, a distance B (=h−R) obtained by subtracting the outer diameter radius R of the screw shaft 51 from a height h of apexes of outer circumference surfaces 41*j* of the semi-circular portions 41*c* and 41*d* serving as a highest point of the rib member 41 from the rotational center o of the screw shaft 51 is considered. Further, preferably, only the conveying surface 41*g* of the rib member 41 that is at the height position of about 8/10 (about 80%) of the distance B (=h−R) is considered.

The distance B (=h−R) obtained by subtracting the outer diameter radius R of the screw shaft 51 from the height h of the apexes of the outer circumference surfaces 41*j* of the semi-circular portions 41*c* and 41*d* serving as the highest point of the rib member 41 based on the outer circumferential portion 51*c* of the screw shaft 51 is considered. The developer collides with the conveying surface 41*g* of the rib member 41 that is at the height position lower than about 8/10 (about 80%) of the distance B (=h−R). In this case, energy is small, and the outer circumference of the collided developer is surrounded by a lot of developer. Thus, the developer does not receive energy that is so strong as to cause the developer to leak from the outlet 40, and discharging of the developer from the outlet 40 is suppressed.

The developer does not leak from the outlet 40 after colliding with the rib member 41. Thus, the following is considered based on the outer circumferential portion 51*c* of the screw shaft 51 on the conveying surface 41*g* of the rib member 41 at the rotation direction upstream side illustrated in FIG. 17. The distance B (=h−R) obtained by subtracting the outer diameter radius R of the screw shaft 51 from the height h of the apexes of the outer circumference surfaces 41*j* of the semi-circular portions 41*c* and 41*d* serving as the highest point of the rib member 41 is considered. Further, it is necessary to prevent the developer from colliding with the conveying surface 41*g* of the rib member 41 at the semi-circular portions 41*c* and 41*d* side rather than a point Q at a height h1 of about 8/10 (about 80%) of the distance B (=h−R).

In other words, in a cross section of a point at the distance x in at least the rib member 41 formed in the first region, a second straight line K passes through the point Q illustrated in FIG. 17 that is at a certain height position on the developer conveying surface 41*g* (on the conveying surface) of the rib member 41. Further, the second straight line K passes through the rotational center o of the screw shaft 51 of the first conveying screw 25. Preferably, the second straight line K does not catch up with the developer churned up by the downstream end portion U of the screw blade 51*a*.

Thus, when the rotation direction of the first conveying screw 25 is assumed to be positive, in the cross section of the screw blade 51*a* of the first conveying screw 25 in the border line Lc serving as the border portion between the second region and the first region, it is as follows. An angle formed by the first straight line N passing through the circumferential point U1 of the screw blade 51*a* and the rotational center o of the screw shaft 51 and the second straight line K is assumed to be the phase angle α(x) at which the rib member 41 is installed.

Here, as described above, the amount of the developer in the developing container 22 increases, and the developer level increases. The distance B (=h−R) obtained by subtracting the outer diameter radius R of the screw shaft 51 from the height h of the apex of the rib member 41 on the conveying surface 41*g* of the rib member 41 at the rotation direction upstream side illustrated in FIG. 17 is considered. The developer collides with the conveying surface 41*g* of the rib member 41 at the semi-circular portions 41*c* and 41*d* side rather than the point Q at the height h1 of about 8/10 (about 80%) of the distance B (=h−R). In this case, the developer level is sufficiently high, and the developer is plentiful around the developer that has collided with the conveying surface 41*g* of the rib member 41. In this case, the developer churned up by the downstream end portion U of the screw blade 51*a* is unlikely to be further churned up by the rib member 41 and overflow from the outlet 40.

The rotation speed ωd applied to the developer by the downstream end portion U of the screw blade 51*a* is the speed represented by Formula 1. The rotation speed ωd actually applied to the developer by the downstream end portion U of the screw blade 51*a* can be obtained using a known high-speed camera (not illustrated).

<Measurement of Rotation Speed Applied to Developer by Downstream End Portion of Blade Portion>

First, the developing container 22 is fixed to a fixture (not illustrated) that can be driven similarly to the image forming apparatus 36 illustrated in FIG. 1, and a high-speed camera (not illustrated) is installed at the position substantially vertical to the outlet 40 so that the rib member 41 and the downstream end portion U of the screw blade 51*a* are viewed from the outlet 40. If the whole is not viewed from the outlet 40, the periphery of the outlet 40 is appropriately cut and removed. In the present embodiment, the periphery of the outlet 40 was cut in a laid U shape by 10 mm and removed.

Then, a desired amount of the developer is inserted into the developing container 22, and driving is performed according to a setting similar to that of the image forming apparatus 36 illustrated in FIG. 1. Thereafter, photographing is performed at a frame rate (a value indicating the number of frames (videos) processed per unit time in a moving image) at which a mass of developer can be recognized well.

In the present embodiment, photographing was performed for one second at 2000 fps (frames per second) using a high-speed camera having a resolution of 1024×1024. If the frame rate is increased, a video gets darker, and thus a light source is used as necessary. In the present embodiment, a xenon lamp light source available from Tokina Corporation was used.

Then, the number of pixels by which the developer has moved in a rotation direction on an image is obtained for each frame of a photographed video. It is unnecessary to perform the comparing in units of frames, and the comparing may be performed in units of 100 frames if it is possible to track the developer. As a result, an amount of movement of the developer at a moment in which the developer is churned up by the downstream end portion U of the screw blade 51*a* is obtained. The tracking of the developer may be performed by visual observation or may be performed based on contrasting density obtained by converting density of an image.

Then, an amount of movement in the rotation direction of the first conveying screw 25 starting from the downstream end portion U of the screw blade 51*a* is also obtained. Then, a ratio γ of the amount of movement of the first conveying screw 25 and the amount of movement of the developer indicating the number of pixels by which the developer has moved in the rotation direction on the image for each frame of the video photographed by the high-speed camera is obtained. At this time, it is desirable that the developer and the first conveying screw 25 are simultaneously photographed by the high-speed camera.

γ is as follows in the border line Lc serving as the border portion between the second region and the first region. γ is a value obtained by dividing the moving velocity of the developer conveyed by the screw blade 51*a* of the first conveying screw 25 in the rotation direction of the screw blade 51*a* by the moving velocity of the outer circumferential portion 51*d* in the screw blade 51*a* in the rotation direction of the screw blade 51*a*.

Here, when the amount of movement of the developer and the first conveying screw 25 in the rotation direction is obtained, an amount of movement is obtained at a point substantially traversing a straight line connecting a lens of the high-speed camera with the rotational center o of the screw shaft 51. There are cases in which it is difficult to properly obtain the amount of movement of the developer and the first conveying screw 25 in the rotation direction at a point obviously deviated from the point substantially traversing the straight line connecting the lens of the high-speed camera with the rotational center o of the screw shaft 51.

There is a distribution for the amount of movement of the developer churned up by the downstream end portion U of the screw blade 51*a* in the rotation direction, and when the distribution is scattered, an average value thereof is used as the amount of movement of the developer in the rotation direction in the downstream end portion U of the screw blade 51*a*. The rotation speed (or the angular speed) of the developer is calculated based on the amount of movement in the rotation direction obtained as described above. γ can be calculated by dividing the calculated value by the rotation speed (or the angular speed) of the first conveying screw 25.

In the present embodiment, the photographing was performed using FASTCAM SA4 available from Photron Limited as the high-speed camera. The ratio γ obtained by dividing the amount of movement of the developer in the rotation direction indicating the number of pixels by which the developer has moved in the rotation direction on the image for each frame of the video photographed by the high-speed camera by the amount of movement of the first conveying screw 25 in the rotation direction was 0.57. Using the ratio γ, the rotation speed ωd applied to the developer by the downstream end portion U of the screw blade 51*a* in the portion, in which the screw blade of the first region is omitted, facing the outlet 40, and the rotation speed ωr of the first conveying screw, a relation represented by the following Formula 6 is obtained.

$$\gamma=\omega d/\omega r \qquad \text{[Math. 6]}$$

The following Formula 7 is obtained using Formulas 5 and 6.

$$\theta d-\theta r=(\omega d/\omega r-1)\times 360\times(x/p)-\alpha(x)=(\gamma-1)\times 360\times(x/p)-\alpha(x) \qquad \text{[Math. 7]}$$

Figure 18:
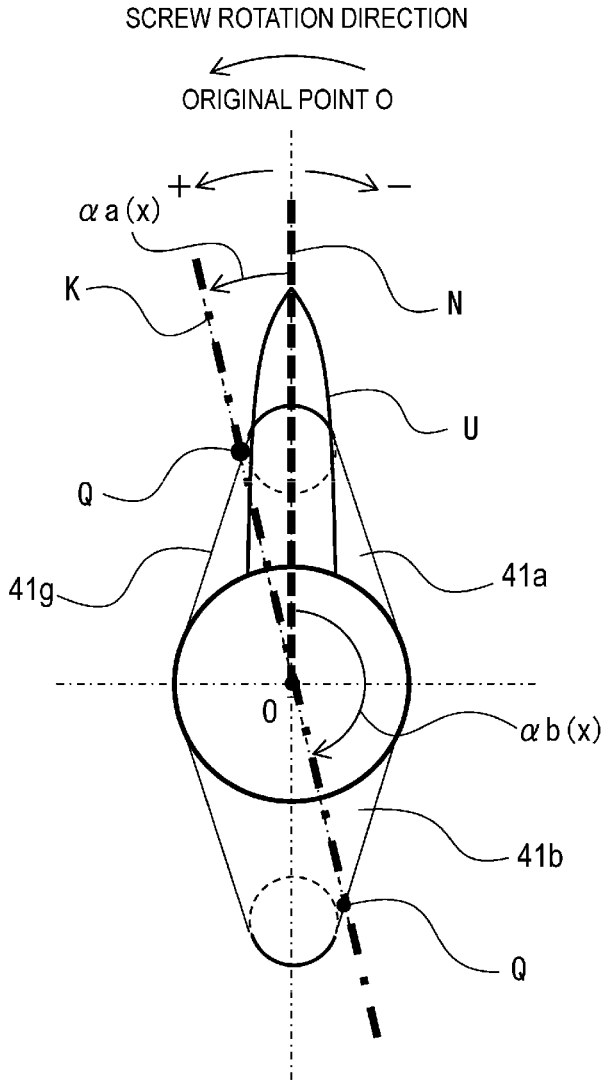
FIG. 18 is an explanatory cross-sectional view illustrating a configuration of a developing apparatus according to the present invention.

In the present embodiment, as the distances L1 and L2 of the upstream end portion 41*h* and the downstream end portion 41*i* of the rib member 41 in the shaft line direction of the screw shaft 51 from the border line Lc illustrated in FIG. 11, the distance L1 is 4 mm, and the distance L2 is 12 mm. The phase angles αa(x) and αb(x) at which the two long axis portions 41*a* and 41*b* of the rib member 41 are installed are independent of the distance x in the shaft line direction of the screw shaft 51 when the border line Lc is used as the reference as illustrated in FIG. 18.

Usually, the two long axis portions 41*a* and 41*b* are installed at the phase angles of αa(x)=+9.86° and αb(x)=−170.14° with respect to the downstream end portion U of the screw blade 51*a*. In a cross section illustrated in FIG. 18, a center line of the rib member 41 and a center line of the downstream end portion U of the screw blade 51*a* overlap on the first straight line N.

Figure 19:
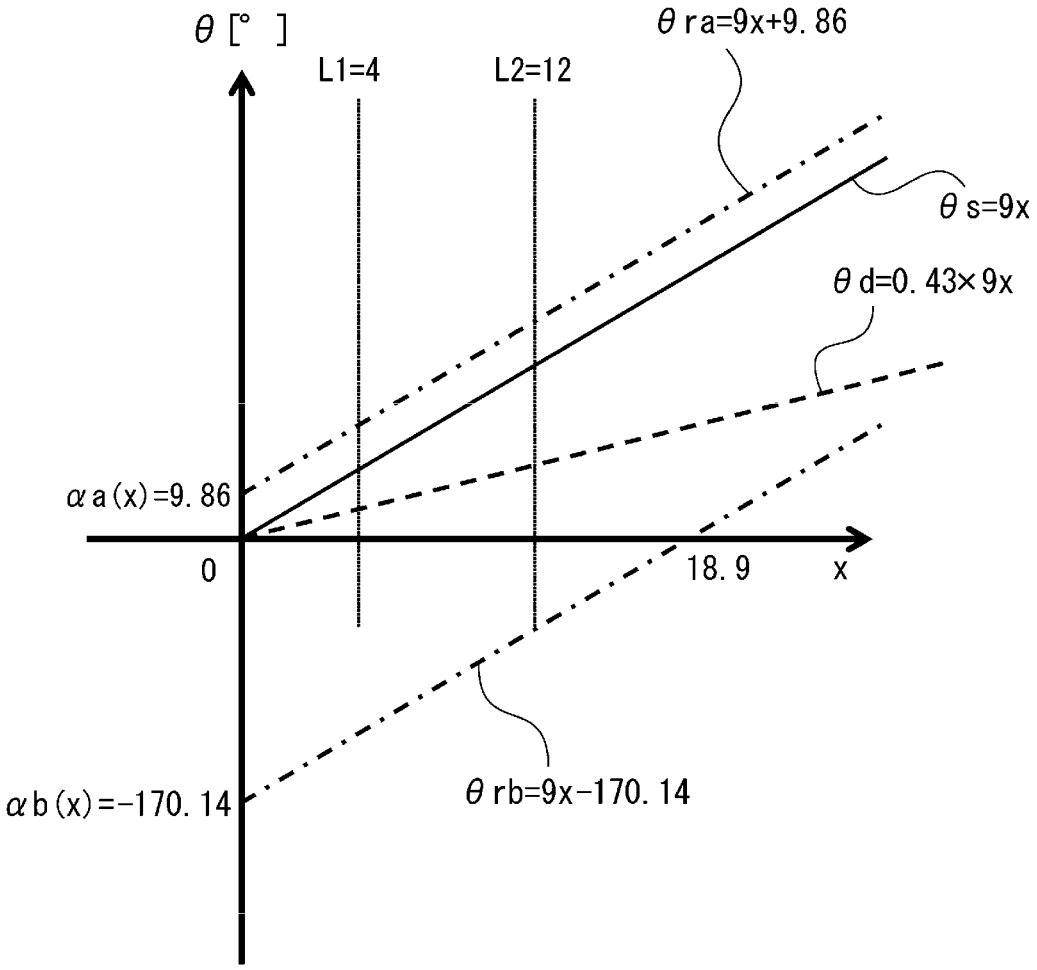
FIG. 19 is a diagram for describing a configuration of a developing apparatus according to the present invention.

Thus, the rotational angle of the first conveying screw 25 is assumed to be θs. An angle at which the developer churned up by the downstream end portion U of the screw blade 51*a* rotates is assumed to be θd. After the developer is churned up by the downstream end portion U of the screw blade 51*a*, the rib member 41 rotates. Further, the reaching angles of the two long axis portions 41*a* and 41*b* of the rib member 41 when the developer reaches the position corresponding to the distance x in the shaft line direction of the screw shaft 51 from the border line Lc are assumed to be θra and θrb. In this case, θra and θrb are illustrated in FIG. 19.

A relation indicated by the following Formula 9 is satisfied on all xes in a range indicated by the following Formula 8.

$$L1=4\leq x\leq L2=12 \quad \text{[Math. 8]}$$

$$\theta d-\theta ra=(\gamma-1)\times 360\times(x/p)-\alpha a(x)=0.43\times 360\times(x/40)-9.86\neq 0 \quad \text{[Math. 9]}$$

and $$\theta d-\theta rb=(\gamma-1)\times 360\times(x/p)-\alpha b(x)=0.43\times 360\times(x/40)+17.014\neq 0$$

The long axis portions 41*a* and 41*b* of the rib member 41 reach the position corresponding to the distance x of the developer in the shaft line direction of the screw shaft 51 from the border line Lc as illustrated in FIG. 19. At this time, straight lines indicating the reaching angles θra and θrb of the two long axis portions 41*a* and 41*b* of the rib member 41 are as follows. In the range indicated by Formula 8, the straight lines do not intersect with the straight line for the angle θd at which the developer churned up by the downstream end portion U of the screw blade 51*a* rotates.

As a result, the developer churned up by the downstream end portion U of the screw blade 51*a* is not overtaken by the long axis portions 41*a* and 41*b* of the rib member 41 while passing through the region in which the long axis portions 41*a* and 41*b* of the rib member 41 are installed. Thus, the developer churned up and hoisted by the downstream end portion U of the screw blade 51*a* is not further churned up by the long axis portions 41*a* and 41*b* of the rib member 41. As a result, the developer does not leak from the outlet 40.

Figure 20:
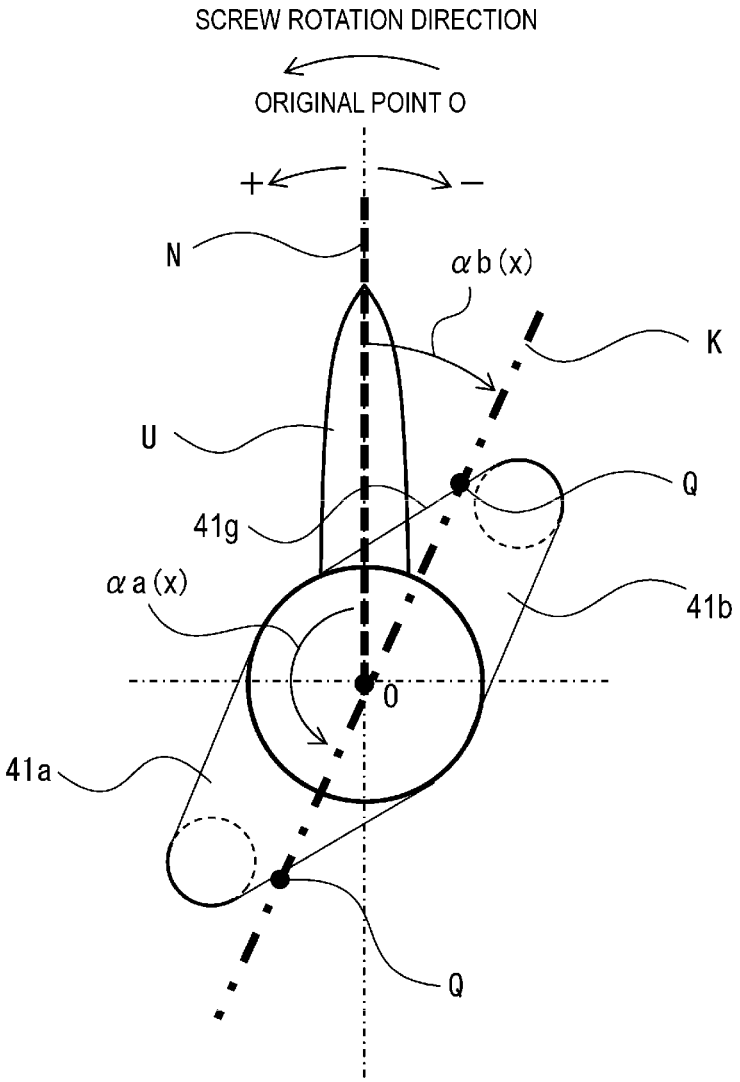
FIG. 20 is an explanatory vertical cross-sectional view for describing a configuration of a developing apparatus according to a comparative example.

Meanwhile, FIG. 20 illustrates a comparative example. In the comparative example illustrated in FIG. 20, as the distances L1 and L2 of the upstream end portion 41*h* and the downstream end portion 41*i* of the rib member 41 in the shaft line direction of the screw shaft 51 from the border line Lc, the distance L1 is 4 mm, and the distance L2 is 12 mm.

The phase angles αa(x) and αb(x) at which the two long axis portions 41*a* and 41*b* of the rib member 41 are installed are as follows. The two long axis portions 41*a* and 41*b* are installed at the phase of the phase angle αa(x)=+140.86° and the phase angle αb(x)=−30.14° with respect to the downstream end portion U of the screw blade 51*a*.

Figure 21:
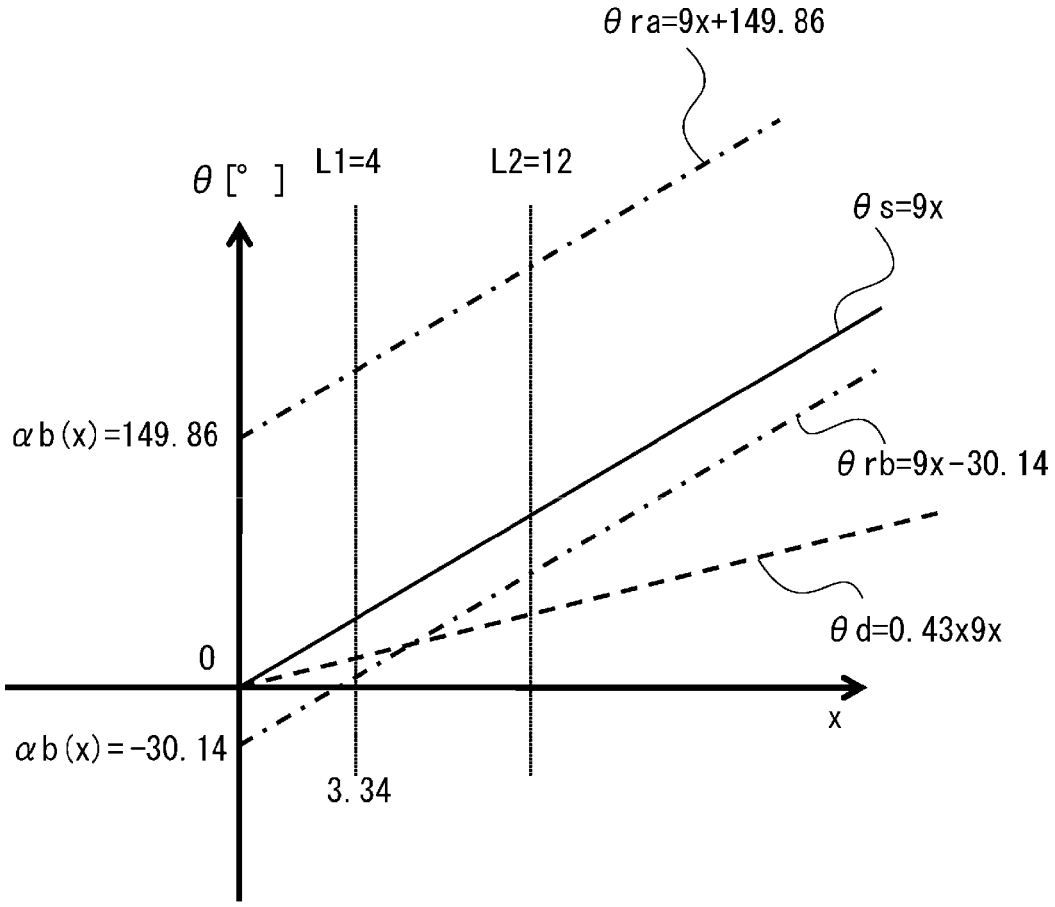
FIG. 21 is a diagram for describing a configuration of a developing apparatus according to a comparative example.

At this time, the rotational angle of the first conveying screw 25 is assumed to be θs, and the angle at which the developer churned up by the downstream end portion U of the screw blade 51*a* rotates is assumed to be θd. After the developer is churned up by the downstream end portion U of the screw blade 51*a*, the rib member 41 rotates. Further, the reaching angles of the two long axis portions 41*a* and 41*b* of the rib member 41 when the developer reaches the position corresponding to the distance x in the shaft line direction of the screw shaft 51 from the border line Lc are assumed to be θra and θrb. The reaching angles θra and θrb are illustrated in FIG. 21. A relation indicated by the following Formula 10 is satisfied on all xes in a range indicated by the following Formula 8.

$$\theta d-\theta ra=(\gamma-1)\times 360\times(x/p)-\alpha a(x)=0.43\times 360\times(x/40)-149.86\neq 0 \quad \text{[Math. 10]}$$

and $$\theta d-\theta rb=(\gamma-1)\times 360\times(x/p)-\alpha b(x)=0.43\times 360\times(x/40)+30.14\neq 0$$

The long axis portion 41*a* of the rib member 41 reaches the position corresponding to the distance x of the developer in the shaft line direction of the screw shaft 51 from the border line Lc as illustrated in FIG. 21. At this time, a straight line indicating the reaching angle θra of one long axis portion 41*a* of the rib member 41 does not intersect with the straight line indicating the angle θd at which the developer churned up by the downstream end portion U of the screw blade 51*a* rotates in the range indicated by Formula 8.

As a result, the developer churned up by the downstream end portion U of the screw blade 51*a* is not overtaken by the long axis portion 41*a* of the rib member 41 while passing through the region in which the long axis portion 41*a* of the rib member 41 is installed. Thus, the developer churned up and hoisted by the downstream end portion U of the screw blade 51*a* is not further churned up by the long axis portion 41*a* of the rib member 41. As a result, the developer does not leak from the outlet 40.

Meanwhile, the other long axis portion 41*b* of the rib member 41 reaches the position corresponding to the distance x of the developer in the shaft line direction of the screw shaft 51 from the border line Lc as illustrated in FIG. 21. A this time, a straight line indicating the reaching angle θrb of the other long axis portion 41*b* of the rib member 41 intersects with the straight line indicating the angle θd at which the developer churned up by the downstream end portion U of the screw blade 51*a* rotates in the range indicated by Formula 8.

As a result, the developer churned up by the downstream end portion U of the screw blade 51*a* is overtaken by the long axis portion 41*b* of the rib member 41 while passing through the region in which the long axis portion 41*b* of the rib member 41 is installed. Thus, the developer churned up and hoisted by the downstream end portion U of the screw blade 51*a* is further churned up by the long axis portion 41*b* of the rib member 41. Accordingly, the developer is likely to overflow out of the outlet 40.

<Measurement of Amount of the Developer Leaking from Outlet>

Figure 22A:
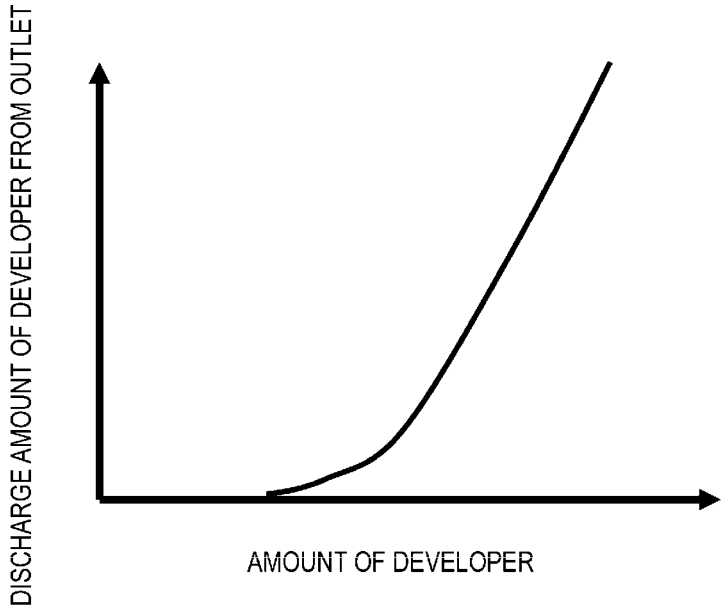
FIG. 22A is a diagram for describing an effect of a developing apparatus according to the present invention.
Figure 22B:
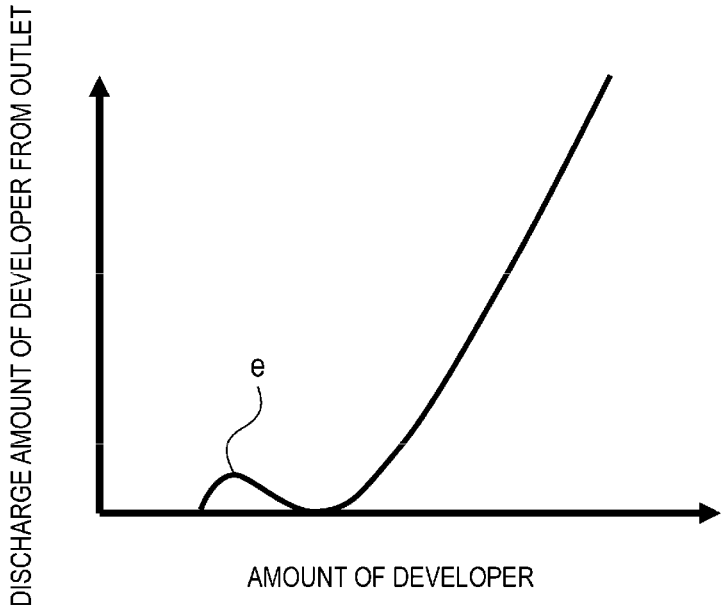
FIG. 22B is a diagram for describing an effect of a developing apparatus according to a comparative example.

FIG. 22A illustrates a measured amount of the developer leaking from the outlet 40 according to the present embodiment illustrated in FIG. 18. FIG. 22B illustrates a measured amount of the developer leaking from the outlet 40 according to the comparative example illustrated in FIG. 20. The amount of the developer leaking from the outlet 40 may be measured as follows.

First, the developer is inserted into the developing container 22 until the surface of the developing sleeve 28 is uniformly coated with the developer in a state in which the developing sleeve 28 and the first and second conveying screws 25 and 26 are rotationally driven at a certain circumferential velocity. Then, the developing sleeve 28 and the first and second conveying screws 25 and 26 are rotationally driven at a certain circumferential velocity until the circulation of the developer in the developing container 22 becomes the stationary state. Commonly, the developing sleeve 28 and the first and second conveying screws 25 and 26 are rotationally driven for about one or two minutes.

Then, after the surface of the developing sleeve 28 is uniformly coated with developer, the developer is inserted into the supply port 30 illustrated in FIG. 3 into the developing container 22 little by little, and a discharge amount of the developer per unit time discharged from the outlet 40 at this time is measured.

In the present embodiment, the developer is inserted into the supply port 30 illustrated in FIG. 3 into the developing container 22 by 10 g, and a discharge amount of the developer per unit time discharged from the outlet 40 is measured for 30 seconds. As a result, a discharge amount of the developer per unit time discharged from the outlet 40 was measured.

In both the present embodiment illustrated in FIG. 22A and the comparative example illustrated in FIG. 22B, as the amount of the developer increases, the discharge amount of the developer increases. However, in the comparative example illustrated in FIG. 22B, there is a point e at which the discharge amount of the developer has a peak before the discharge amount of the developer increases in earnest. It is because when the amount of the developer is small, the developer is churned up by the downstream end portion U of the screw blade 51*a*, then collides with the rib member 41, and overflows from the outlet 40.

Meanwhile, in the case of the present embodiment illustrated in FIG. 22A, the rib member 41 is installed at the phase angle $\alpha(x)$ at which it runs away from the developer churned up by the downstream end portion U of the screw blade 51*a*. Thus, there is no point e at which the discharge amount of the developer has the peak as in the comparative example illustrated in FIG. 22B.

Thus, in the case of the present embodiment illustrated in FIG. 22A, only an actual surplus developer is discharged from the outlet 40. As a result, the surface of the developing sleeve 28 is stably coated with the developer over a long period, and thus it is possible to suppress an adverse effect of an image such as density irregularity of an image.

In the present embodiment, a protruding portion such as a small diameter screw or a member for vibrating the developer is installed in the screw shaft 51. In this case, the developer is suppressed from being churned up and discharged, and only an actual surplus developer is discharged. As a result, the surface of the developing sleeve 28 is stably coated with the developer over a long period, and thus it is possible to suppress an adverse effect of an image such as density irregularity of an image.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-107192, filed May 23, 2014, which is hereby incorporated by reference herein in its entirety.

What is claimed is:

1. A developing apparatus, comprising:

a developer bearing member which bears a developer including a toner and a magnetic carrier;

a developing container that includes a circulation path in which the developer circulates and contains the developer to be supplied to the developer bearing member;

a conveying member which is rotatably installed in the circulation path, and conveys the developer in the circulation path; and an outlet which is formed on a side surface of the circulation path facing the conveying member, and is able to discharge the developer;

wherein the conveying member includes a rotating shaft which is rotatable and a helical blade portion which is formed around the rotating shaft, wherein the conveying member has a first region including a region facing the outlet and a second region adjacent to the first region at an upstream in a conveying direction of the conveying member, the helical blade portion is not formed in the first region, a protruding portion protruding from the rotating shaft is formed in at least a part of the first region, and the helical blade portion is formed in the second region, and wherein the length of the protruding portion about the shaft diameter direction of the conveying member is shorter than the maximum outer diameter of the helical blade portion of the conveying member, and the following formula is satisfied of $L1 \leq x \leq L2$, $(\gamma-1)\times 360\times(x/p)-\alpha(x)\neq 0$, where x is a distance in a shaft line direction of the rotating shaft based on an end point of the first region at an uppermost stream side in the conveying direction of the conveying member, L1 is a distance in the shaft line direction of the rotating shaft between the end point of the first region at the uppermost stream side in the conveying direction of the conveying member and an end point of the protruding portion at an upstream side in the conveying direction of the conveying member, L2 is a distance in the shaft line direction of the rotating shaft between the end point of the first region at the upstream side in the conveying direction of the conveying member and an end point of the protruding portion at a downstream side in the conveying direction of the conveying member, $\gamma$ is a value obtained by dividing an angular speed of the developer conveyed by the helical blade portion around the rotating shaft of the conveying member at the end point of the second region at the downstream side by an angular speed of the conveying member, p is a pitch of the helical blade portion of the conveying member in the second region, and $\alpha(x)$ is an angle that is formed by a first straight line and a second straight line when the rotation direction of the conveying member is positive, the first straight line passing an apex of the helical blade portion at the end point of the second region at the downstream side and a rotational center of the rotating shaft of the conveying member, the second straight line passing through a point that is at a region protruding from the rotating shaft by $0.8\times B$ or more on a developer conveying surface of the protruding portion in a cross section of a point of the distance x in the protruding portion and the rotational center of the rotating shaft, wherein B indicates a distance obtained by subtracting a shaft diameter from an apex of the protruding portion.

2. The developing apparatus according to claim 1, wherein an average angle of an angle formed by the developer conveying surface of the protruding portion formed in the first region and the rotating shaft is set to be smaller than an average angle of an angle formed by a developer conveying surface of the helical blade portion formed in the second region and the rotating shaft.

3. An image forming apparatus, comprising:

the developing apparatus according to claim 1; and an image bearing member that bears an electrostatic latent image, wherein the developer is supplied to the electrostatic latent image borne on the image bearing member through the developing apparatus to form an image.

4. An image forming apparatus, comprising:

the developing apparatus according to claim 2; and an image bearing member that bears an electrostatic latent image, wherein the developer is supplied to the electrostatic latent image borne on the image bearing member through the developing apparatus to form an image.

* * * * *